US009148712B2

(12) United States Patent
Dehe

(10) Patent No.: US 9,148,712 B2
(45) Date of Patent: Sep. 29, 2015

(54) MICROMECHANICAL DIGITAL LOUDSPEAKER

(75) Inventor: Alfons Dehe, Reutlingen (DE)

(73) Assignee: Infineon Technologies AG, Neubiberg (DE)

( * ) Notice: Subject to any disclaimer, the term of this patent is extended or adjusted under 35 U.S.C. 154(b) by 1299 days.

(21) Appl. No.: 12/965,391

(22) Filed: Dec. 10, 2010

(65) Prior Publication Data

US 2012/0148071 A1 Jun. 14, 2012

(51) Int. Cl.

| | |
|---|---|
| ***H04R 25/00*** | (2006.01) |
| ***H04R 1/00*** | (2006.01) |
| *H04R 9/06* | (2006.01) |
| *H04R 17/00* | (2006.01) |
| *H04R 19/00* | (2006.01) |
| *H04R 19/02* | (2006.01) |

(52) U.S. Cl.

CPC *H04R 1/005* (2013.01); *H04R 9/06* (2013.01); *H04R 17/00* (2013.01); *H04R 19/005* (2013.01); *H04R 19/02* (2013.01); *H04R 2201/003* (2013.01); *Y10T 29/49005* (2015.01)

(58) Field of Classification Search

CPC ..... H04R 19/016; H04R 19/02; H04R 19/00; H04R 19/013; H04R 2217/03; H04R 31/00; H04R 17/005; H04R 19/005; H04R 19/04; H04R 2307/201; H04R 2499/11; H04R 2499/13; H04R 25/604; H04R 25/606; H04R 7/04; H04R 9/047

USPC ..... 381/191, 174, 175, 116, 113, 431; 438/198; 367/181

See application file for complete search history.

(56) References Cited

U.S. PATENT DOCUMENTS

| | | | | |
|---|---|---|---|---|
| 1,799,053 | A * | 3/1931 | Mache | 381/191 |
| 6,243,474 | B1 * | 6/2001 | Tai et al. | 381/174 |
| 6,535,612 | B1 * | 3/2003 | Croft et al. | 381/191 |
| 7,620,192 | B2 * | 11/2009 | Yamaoka et al. | 381/175 |
| 7,829,366 | B2 * | 11/2010 | Miller et al. | 438/53 |
| 7,961,897 | B2 * | 6/2011 | Weigold | 381/174 |
| 8,009,846 | B2 * | 8/2011 | Sekino et al. | 381/191 |
| 2002/0114478 | A1 * | 8/2002 | Ohashi | 381/191 |
| 2005/0254673 | A1 * | 11/2005 | Hsieh et al. | 381/175 |
| 2006/0125348 | A1 | 6/2006 | Smith et al. | |
| 2008/0104825 | A1 | 5/2008 | Dehe et al. | |
| 2010/0008521 | A1 | 1/2010 | Cohen et al. | |
| 2010/0239101 | A1 | 9/2010 | Okamura et al. | |
| 2012/0148071 | A1 * | 6/2012 | Dehe | 381/116 |
| 2012/0148074 | A1 * | 6/2012 | Bastiaens et al. | 381/191 |

FOREIGN PATENT DOCUMENTS

| | | | |
|---|---|---|---|
| CN | 101356852 | A | 1/2009 |
| CN | 101803401 | A | 8/2010 |
| DE | 10 2004 011 145 | B4 | 1/2006 |
| WO | 2007081584 | A2 | 7/2007 |
| WO | WO 2007/135680 | A1 | 11/2007 |

* cited by examiner

*Primary Examiner* — Davetta W Goins
*Assistant Examiner* — Phylesha Dabney
(74) *Attorney, Agent, or Firm* — Slater & Matsil, L.L.P.

(57) ABSTRACT

A digital loudspeaker includes a substrate, a first stator fixed with respect to the substrate, a second stator fixed with respect to the substrate and spaced at a distance from the first stator, and a membrane between the first stator and the second stator. The membrane is displaceable between a first position in which the membrane mechanically contacts the first stator and a second position in which the membrane mechanically contacts the second stator. The first stator and the second stator are arranged to electrostatically move the membrane from a rest position spaced apart from the first position and the second position to the first position and the second position, respectively.

17 Claims, 25 Drawing Sheets

MICROMECHANICAL DIGITAL LOUDSPEAKER

TECHNICAL FIELD

Some embodiments according to the invention are related to a digital loudspeaker. Some embodiments according to the invention are related to a method for manufacturing a digital loudspeaker. Some embodiments according to the invention are related to a method for operating a digital loudspeaker.

BACKGROUND

A majority of the loudspeakers manufactured and used today are of the electrodynamic type. A common design of an electrodynamic speaker includes a permanent magnet, a moveable coil within a magnetic field produced by the permanent magnet, and a membrane attached to the moveable coil. An alternating electric current flowing through the coil causes the coil to oscillate within the magnetic field, thus driving the membrane, which in turn produces a sound. An electrodynamic loudspeaker typically has a relatively large back volume behind the membrane, i.e., at a side of the membrane opposite to the side of the membrane from which the sound waves are propagated to the environment. The size of the back volume of an electrodynamic loudspeaker typically is reciprocally related to the intended frequency range of the loudspeakers, that is, a loudspeaker of a low frequency range typically has a relatively large back volume.

Notable alternatives to electrodynamic loudspeakers are piezoelectric loudspeakers and electrostatic loudspeakers.

Besides the underlying physical phenomenon that is used in a loudspeakers (electrodynamic, piezoelectric, electrostatic, etc.), loudspeakers may also be distinguished by their structure and their method of manufacture. In recent years various solutions were proposed that are aimed at manufacturing loudspeakers based on micromechanical constructions. Some of these solutions propose the use of piezoelectric or ferroelectric materials on micromechanical membranes made from silicon. For the manufacture of such micromechanical loudspeakers, a new material system is integrated into the semiconductor manufacturing process. Typically, the loudspeakers manufactured in this manner are analog transducers, as are the majority of today's loudspeakers.

In contrast to analog loudspeakers, digital loudspeakers use pressure waves having discrete sound pressure levels (SPL). To this end, the sound producing element within the digital loudspeaker performs a predefined movement of a predefined amplitude. A digital-to-analog conversion, which is typically performed electrically and upstream of an electrical input of an analog loudspeaker in many modern electronic devices, is actually moved to the sound or pressure variation side of a digital loudspeaker. The ear of a listener may also be involved in the digital-to-analog conversion of the digital sound signal. Digital loudspeakers typically comprise relatively large arrays of basic transducer elements.

SUMMARY OF THE INVENTION

Some embodiments according to the invention provide a digital loudspeaker comprising a substrate, a first stator, a second stator, and a membrane. The first stator and the second stator are fixed with respect to the substrate and the second stator is spaced at a distance from the first stator. The membrane is arranged between the first stator and the second stator and is displaceable between a first position in which the membrane mechanically contacts the first stator and a second position in which the membrane mechanically contacts the second stator. The first stator and the second stator are arranged to electrostatically move the membrane from a rest position to the first position and the second position, respectively. The rest position is spaced apart from the first position and the second position, typically between the first position and the second position.

In another embodiment according to the teachings disclosed herein, a digital loudspeaker comprises a membrane, a first stator, and a second stator. The membrane has a first main surface and is arranged in a sound transducing region of the digital loudspeaker. The first stator has a second main surface in parallel to the first main surface of the membrane on a side of a first free volume that is opposite the first main surface of the membrane, i.e., the first free volume is on the other side of the membrane than the first main surface. The second stator has a third main surface in parallel to the first main surface of the membrane on a side of a second free volume adjacent to the first main surface. The membrane has a rest position spaced apart from the first stator and the second stator, for example, between the first stator and the second stator. The first stator and the second stator are adapted to electrostatically attract the membrane towards the first stator or the second stator until the membrane mechanically contacts the first stator or the second stator, respectively.

Another embodiment of a digital loudspeaker according to the teachings disclosed herein comprise a means for being deflected from a rest position to a first end position and to a second end position in response to an electrostatic excitation. A first abutting means is located substantially at the first end position and a second abutting means is located substantially at the second end position. The means for being deflected is adapted to mechanically contact the first abutting means when being in the first end position. The means for being deflected is also adapted to mechanically contact the second abutting means when being in the second end position.

A method for manufacturing a digital loudspeaker according to the teachings disclosed herein comprises applying a first stator material on a first main surface of a base structure. A sacrificial material with a first sacrificial material thickness $t_1$ is applied on a first main surface of the stator material opposite the first main surface of the base structure. A membrane material on a first main surface of the sacrificial material is applied opposite the first main surface of the stator material. A further sacrificial material with a second sacrificial material thickness $t_2$ is applied on a first surface of the membrane material opposite the first main surface of the sacrificial material. The sacrificial material and the further sacrificial material in a sound transducing region of the digital speaker is removed. The first sacrificial material thickness $t_1$ and the second sacrificial material thickness $t_2$ are suitably chosen to allow the membrane material, when being electrostatically deflected, to mechanically contact the first stator material or the second stator material after removal of the sacrificial material.

A method for operating a digital loudspeaker according to the teachings disclosed herein comprises applying a first electrical potential to a first stator, applying a second electrical potential to a second stato; and applying a third electrical potential to a membrane. A difference between the first electrical potential, the second electrical potential, and the third electrical potential causes the membrane to be attracted to a first stator or the second stator until it reaches a first end position or a second end position, respectively. In the first end position the membrane mechanically contacts the first stator and in the second end position the membrane mechanically contacts the second stator.

DETAILED DESCRIPTION OF ILLUSTRATIVE EMBODIMENTS

Figure 1:
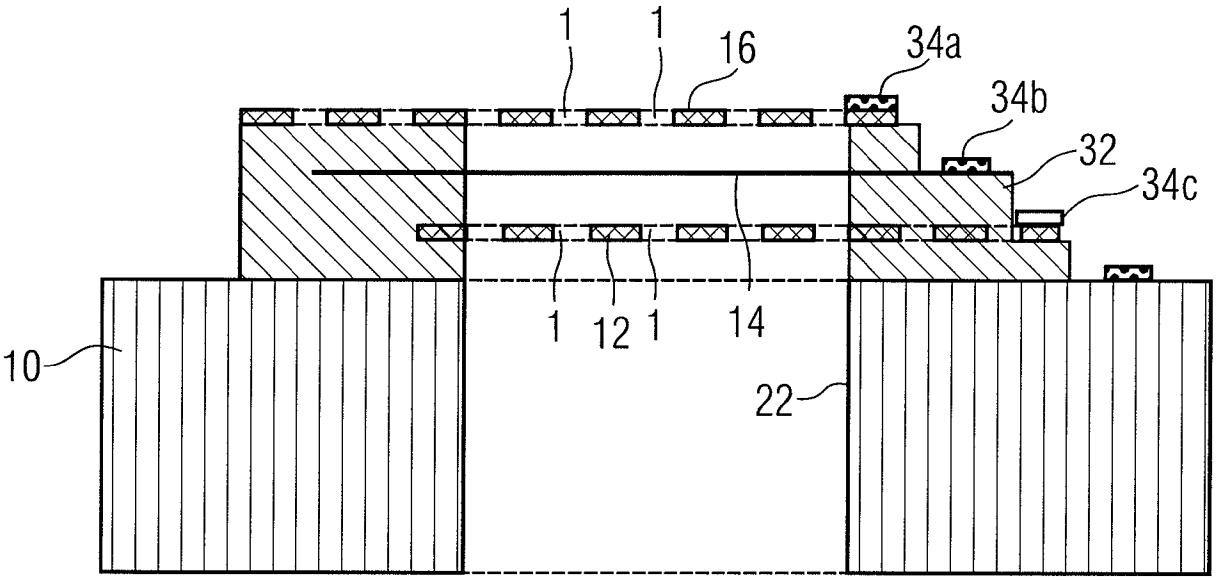
FIG. 1 shows a schematic cross section through a micromechanical, digital loudspeaker according to the teaching disclosed herein.

FIG. 1 shows a schematic cross-section through a micromechanical loudspeaker according to an embodiment of the teachings disclosed herein. The digital loudspeaker comprises a substrate 10, a first stator 12, a second stator 16, and a membrane 14. The first stator 12, the membrane 14, and the second stator 16 are fixed to a support structure 32 which, in turn, is fixed to the substrate 10. The term "being fixed" could mean "mounted to", "attached to", etc. Typically, the first stator 12 and the second stator 16 are substantially rigid, which may be achieved by choosing the thickness and/or the material of the first and second stators 12, 16, appropriately. The membrane 14 is deformable so that especially a central portion of the membrane 14 may be displaced from a rest position to a first end position and a second end position, respectively. The membrane 14 is mechanically connected to the support structure 32 at a circumferential portion of the membrane 14. The displacement of the membrane 14 or its central portion toward the first or second stator 12, 16 may be achieved by exerting an electrostatic force on the membrane 14. In particular, one of the first and second stators 12, 16 may electrostatically attract the membrane 14, while the other of the stators may repel the membrane 14. Generally, it will be sufficient if either a force of attraction or a force of repulsion acts on the membrane 14 so that at a given time one of the stators 12, 16, may be electrostatically neutral with respect to the membrane 14. The electrostatic effect between the stators 12, 16 and the membrane 14 is achieved by applying different electrical potentials to the first stator 12, the second stator 16, and the membrane 14. To this end, the first membrane is electrically connected with a connection pad 34*c*, the membrane 14 is electrically connected with a connection pad 34*b*, and the second stator 16 is electrically connected with a connection pad 34*a*. The connection pads 34*a*-34*c* may be used to electrically connect the digital loudspeaker with a loudspeaker driver or an amplifier by means of, e.g., bond wires. The support structure 32 also acts as an electrical insulator between the first stator 12, the membrane 14, and the second stator 16, and their respective connection pads 34*a*-34*c*.

The substrate 10 has a cavity 22 beneath the first stator 12 which acts as a back volume of the digital loudspeaker and allows the membrane 14 to move relatively freely towards the first stator 12, because any air between the membrane 14 and the first stator 12 may escape to the cavity 22 through a plurality of air holes 1 formed in the first stator 12. Thus, the membrane 14 does not have to overcome a strong counter pressure when moving towards the first stator 12, or a sub-pressure (vacuum) when moving away from the first stator 12. Equally, the second stator 16 comprises similar air holes 1, as well, through which a pressure wave generated by the membrane 14 may be propagated to the environment. In the embodiment shown in FIG. 1, the cavity 22 is open at an opposite side with respect to the membrane-stator arrangement, e.g., at the lower end of the cavity 22, with respect to the representation of FIG. 1. The cavity 22 is continued in the support structure 32 a substantially similar manner so that a first free volume is present above the membrane 14 and a second free volume is presented beneath the membrane 14, or to be more precise, above/beneath a central portion of the membrane 14. These free volumes allow the central portion of the membrane 14 to move up and down and to thereby displace air that is contained in the free volumes. Since a periodical displacement of the air in the free volumes results in a generation of a sound wave, the prolongation of the cavity 22 through the support structure 32 may be regarded as a sound transducing region of the digital loudspeaker.

Generally, an electrostatic loudspeaker comprises at least one capacitor in which one of the plates (i.e., the membrane) is moveable. When operating such a structure as a loudspeaker, the capacitor is typically electrically biased and the electrical input signal representing the audio data to be transduced modulates the electrical field. This modulation of the electrical field within the capacitor causes the membrane to oscillate. Typically, this structure has a square-law force/voltage characteristic and due to the square-law force/voltage characteristic pronounced distortions may occur especially for high input voltages of the audio input signal. These distortions may be particularly irritating at low frequencies, even for relatively weak sound levels. Analog loudspeakers are particularly affected by this tendency of the electrostatic transducer structure to produce relatively strong distortions. By contrast, a digital loudspeaker may be less affected by this tendency of the membrane to produce distortions due to its inherent operating principle. In particular, the membrane of a digital loudspeaker is designed to be in one of a plurality of discrete states or positions for the majority of time. Any transition from a first one of the plurality of discrete states to a second one of the plurality of discrete states is ideally of very short duration compared to the duration during which the membrane is maintained at one of the plurality of discrete states. Thus, the square-law force/voltage characteristic of a membrane can be dealt with in a digital loudspeaker by, e.g., assuring that the membrane locks in at one of the plurality of discrete states. Therefore, an electrostatic transducer structure as illustrated in FIG. 1 is believed to be well suited for the purposes of a digital loudspeaker. Furthermore, an electrostatic structure such as, for example, shown in FIG. 1 is well-suited for being manufactured by means of semiconductor manufacturing processes. Semiconductor manufacturing processes facilitate the manufacture of fine, highly integrated electronic and/or micromechanical structures, such as micromechanical systems (MEMS). This is not necessarily the case for other types of loudspeakers, such as electrodynamic loudspeakers. Electrodynamic loudspeakers typically require certain types of material, e.g., plastic or cardboard for the membrane and permanent magnetic material. These materials are often unable to endure an oven soldering process (typically 260° C.) unharmed. Such oven soldering processes are, for example, used during the assembly of a printed circuit board (PCB). Therefore, additional assembly and connection processes are necessary when using electrodynamic loudspeakers.

A digital loudspeaker is well-suited for using an electrostatic operating principle and such an electrostatic transducer is relatively well-suited for being manufactured by means of semiconductor manufacturing processes or similar processes.

During digital operation of the digital loudspeaker, the membrane 14 can be attracted either to the upper stator 16 or the lower stator 12 by means of a voltage pulse. The voltage may be chosen sufficiently high so that the membrane abuts at the respective stator 12, 16, so that two stable states for the membrane 14 are created. This may be achieved by applying voltages that are greater than, or at least equal to, the so-called pull-in voltage. The pull-in voltage is determined by a balance between a mechanical restoring force and an electrostatic force of attraction/repulsion. Depending on the use of the digital loudspeaker, the membrane 14 may be operated at a clock frequency that corresponds or is close to the resonance frequency of the membrane 14 in order to substantially maximize a conversion of electrical energy to mechanical energy (i.e., sound pressure). The digital loudspeaker illustrated as the schematic cross-section in FIG. 1 may be summarized as follows: the digital loudspeaker comprises an electrostatic transducer which comprises a membrane 14, sandwiched between two stators 12, 16. Unless specifically otherwise indicated, the term "contact" or "contacts" may be understood as "mechanical contacts", "touches", or "abuts".

According to the teaching disclosed herein, the membrane 14 is configured to be deflected to an extent that it mechanically touches the first stator 12 or the second stator 16, due to an electrostatic force acting on the membrane 14. It has been found that this can be achieved by choosing appropriate dimensions for the membrane 14 and the gaps between the membrane 14 and the first and second stators 12, 16. The following information may be useful for the task of sizing the digital loudspeaker and optional elements thereof.

The width of the gap between the membrane 14 and one of the stators 12, 16 corresponds to a first sacrificial material thickness $t_1$ and a second sacrificial material thickness $t_2$, as will be explained below in the context of the description of the process for manufacturing the digital loudspeaker. Typical values for $t_1$ and $t_2$ may be between 0.5 μm and 10 μm, preferably between 0.8 μm and 5 μm, and more preferably between 1 μm and 3 μm. Typically, $t_1$ and $t_2$ are approximately equal.

A membrane has a thickness $t_m$ which is typically between 50 nm and 2000 nm, preferably between 100 nm and 1000 nm, and more preferably between 200 nm and 500 nm. By comparing the exemplary values of the membrane thickness $t_m$ to the exemplary sacrificial material thickness $t_1$, and $t_2$, it can be seen that the gap width $t_1$ or $t_2$ is larger than the membrane thickness $t_m$ by a factor comprised between 2 and 15.

A diameter of a sound transducing region of the digital loudspeaker may be between 0.1 mm and 10 mm, preferably between 0.4 mm and 3 mm, and more preferably between 0.8 mm and 2 mm. These values are indicated for a circular sound transducing region. They may, however, also be applied to other shapes of the sound transducing region and/or of the membrane 14, such as a square, hexagonal, etc., in which case the diameter corresponds to, e.g., the side length of a square, the length of a diagonal of the square, or a side-to-side dimension of a hexagon. As such, the term "diameter" may be more generally regarded as a characteristic dimension of the sound transducing region.

If a corrugation groove 3 is formed in the membrane 14 (see for example FIG. 2), the dimensions of the corrugation groove 3 may be chosen as follows (exemplary only). The width and the depth of the corrugation groove 3 may be between 1 times and 5 times the membrane thickness $t_m$, more preferably between 1.5 $t_m$ and 4 $t_m$, and even more preferably between 2 $t_m$ and 3 $t_m$. If anti-sticking bumps 2 are formed in the membrane (see, for example, FIG. 2), the depth of the anti-sticking bumps may be between 2 $t_m$ and 5 $t_m$, and more preferably between 2 $t_m$ and 3 $t_m$.

By selecting the dimensions of the digital loudspeaker within the indicated ranges, the desired property of the membrane 14 can be achieved, i.e., the ability of the membrane 14 to deflect until it contacts the first stator 12 or the second stator 16, when attracted and/or repelled by an electrostatic force.

Figure 2:
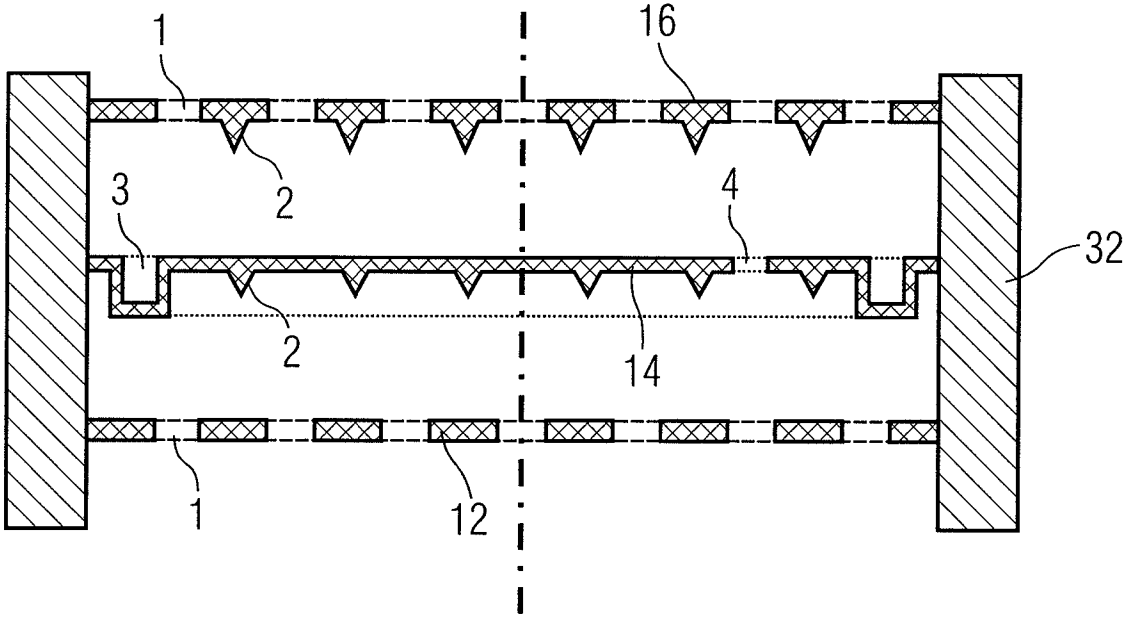
FIG. 2 shows a conceptual drawing of functional elements of a digital loudspeaker according to the teachings disclosed herein.

FIG. 2 shows a cross-section of a digital loudspeaker as a conceptual drawing. The embodiment shown in FIG. 2 comprises some additional features that may improve the performance of the digital loudspeaker. The membrane 14 comprises one or multiple pressure equalization holes 4 for pressure equalization and/or lower frequency band limitation. The pressure equalization hole 4 is primarily intended to equalize static pressure differences between the volume above the membrane 14 and the volume beneath the membrane 14. The area of a pressure equalization hole 4 is typically chosen to be much smaller than the area of the membrane 14 so that the pressure equalization hole 4 has only a negligible effect on dynamic pressure differences occurring during the operation of the digital loudspeaker. The reason is that the relatively small pressure equalization hole 4 has a relatively low flow capacity so that during one oscillation of the membrane 14 only a very small volume of air can flow from the upper volume to the lower volume, or vice versa. This effect is typically desired for the membrane 14 of the digital loudspeaker, because it assures that the membrane 14 is able to displace a relatively large volume of air, while avoiding that the membrane 14 is mechanically biased due to a static pressure difference between the upper free volume and the lower free volume. Accordingly, the pressure equalization holes 4 may be regarded as having a relatively low flow resistance at low frequencies and a relatively high flow resistance at higher frequencies, that is, the pressure equalization holes 4 may be understood as lowpass filters for an airflow from the upper volume to the lower volume and vice versa.

In order to increase the sensitivity of the membrane 14, the membrane may be provided with one or several corrugation groove(s) 3.

The corrugation groove 3 may have a shape that is similar to the shape of the membrane 14, e.g., circular, rectangular, square, oval, etc. The edges of the corrugation groove 3 form a preferred region of flexion of the membrane 14. In the embodiment illustrated in FIG. 2, the corrugation groove 3 is situated relatively close to the circumference of the membrane 14 so that an area enclosed by the corrugation grove 3 corresponds to a relatively large fraction of the entire area of the membrane 14. The area enclosed by the corrugation groove 3 benefits from a large displacement of the membrane 14 in this region. Therefore, a corrugation groove 3 may be provided in order to increase the air volume that is displaced by the membrane 14 during one oscillation. The corrugation groove 3 in FIG. 2 has a square cross-section, but it could have another shape, such as a triangular, semi-circular, or oval cross-section. Furthermore, the corrugation groove 3 could also extend in the direction of the second stator 16, that is upwards in FIG. 2.

Another additional structure illustrated in FIG. 2, but not in FIG. 1, are anti-sticking bumps 2 that are formed at a lower surface of the membrane 14 and the second stator 16, respectively. In order to prevent the membrane 14 from sticking to the stators 12, 16, the membrane 14 or a corresponding stator 12, 16 may be provided with a structure that significantly reduces the contact area between the membrane 14 and the stators 12, 16. It is sufficient that either one of the surfaces of the membrane 14 or the opposite surface of the corresponding stator 12, 16 has the anti-sticking bumps 2. Hence, only the lower surfaces of the membrane 14 and the lower surface of the second stator 16 are provided with the anti-sticking bumps 2, while the first stator 12 does not have the anti-sticking bumps 2. Therefore it is clear that in alternative embodiments the membrane 14 could have anti-sticking bumps 2 on its upper surface and its lower surface, or that the membrane 14 does not have any anti-sticking bumps 2 which are provided instead at the corresponding surfaces of the first and second stators 12, 16.

Although the teachings disclosed herein mainly cover digital loudspeakers, FIGS. 3 and 4 relative to analog, electrostatic loudspeakers and the corresponding description below are provided in order to offer a more complete comprehension of electrostatic loudspeakers and their operation.

Figure 3:
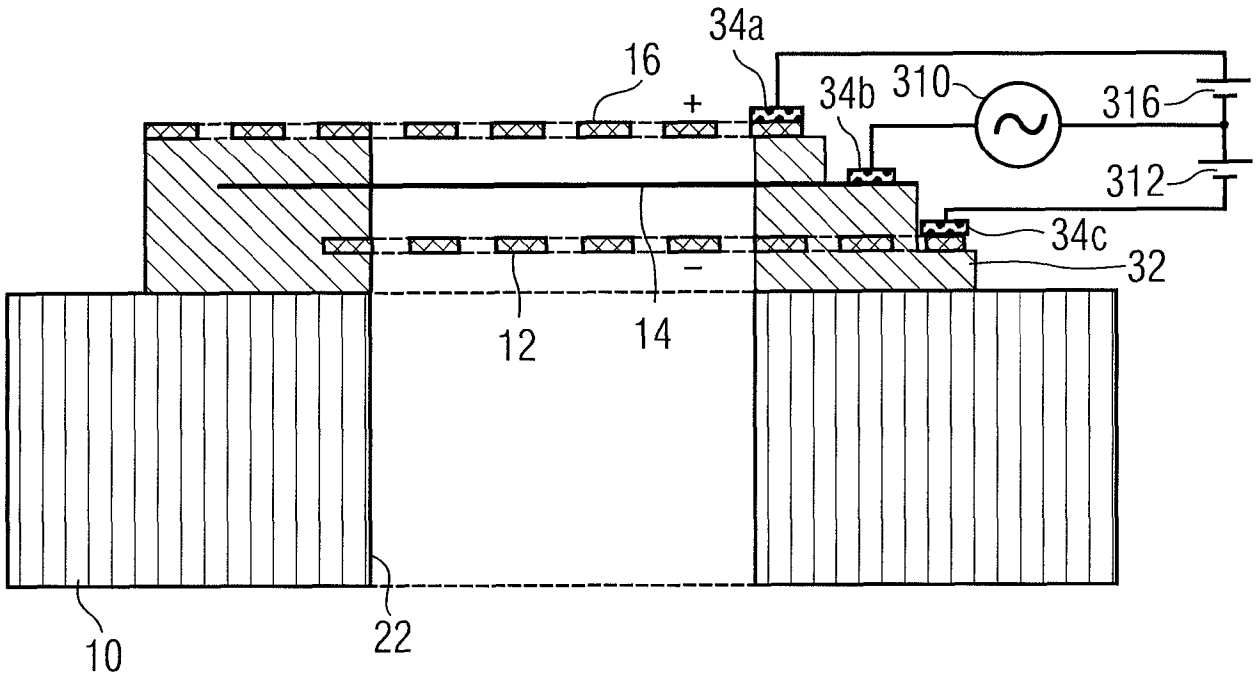
FIG. 3 shows a schematic cross-section through a loudspeaker and a first possible arrangement of an electric circuit for driving a loudspeaker in the analog or digital domain.

FIG. 3 shows an electrostatic loudspeaker structure and an analog driving circuit connected thereto. The first stator 12 is connected to the second stator 16 by means of the respective connection pads 34*c*, 34*a*, and to DC voltage sources 312, 316. Thus, a constant voltage is applied to the stators 12, 16 with the first stator 12 being at a lower electrical potential (negative pole) and the second stator 16 being at a higher electrical potential (positive pole). The membrane 14 is connected via connection pad 34*b* and an alternating voltage source 310 to a node between the two DC voltage sources 312, 316. The AC voltage source 310 typically corresponds to a signal input for the loudspeaker. In this manner, the membrane 14 is electrically wired to an electrical potential that is between the negative electrical potential of the first stator 12 and the positive electrical potential of the second stator 16. Typically, the membrane 14 is electrically biased to approximately the middle of the voltage between the first stator 12 and the second stator 16. During operation of the analog loudspeaker illustrated in FIG. 3, the AC voltage source 310 applies, in an alternating manner, a more positive electrical potential and a more negative electrical potential to the membrane 14, in accordance with the audio signal to be transduced. Upon application of a more positive electrical potential to the membrane 14, the membrane 14 is attracted by the first stator 12 and repelled by the second stator 16. Since the membrane 14 is deformable and thus partly displaceable, the force of attraction and the force of repulsion cause the membrane 14 to move downwards towards the first stator 12. Equally, the membrane 14 is caused to move upwards towards the second stator 16 upon application of a more negative electrical potential to the membrane 14 by means of the AC voltage source 310. The varying electrical potential of the membrane 14 generated by the AC voltage source 310 results in the corresponding mechanical movement of the membrane 14, which in turn produces a sound wave. An ideal analog loudspeaker would have a linear characteristic between sound pressure and voltage of the audio signal produced by the AC voltage source 310, i.e., the sound pressure produced by the loudspeaker is proportional to the voltage of an AC voltage source 310, e.g., by a factor k with the unit Pa/V (Pascal/Volt). The sound pressure could also be proportional to the input power so that the proportionality factor would have the unit Pa/W. As mentioned above, it may be a challenge to achieve a sufficiently high linearity using an electrostatic transducer structure. One option would be to increase the distance between the membrane and the stators as well as the driving voltages so that the actuated membrane movement gets smaller with respect to the capacitor gaps which results into an actuation more in the linear range of the capacitor/voltage characteristics of that transducer. However, excessive topology caused by gap sizes >>5 μm causes significant efforts in surface micromachined MEMS structures. Also very high supply voltages cause difficulties in the driving circuitry for such a device.

The speaker in configuration of FIG. 3 can as well be driven with a digital input signal. Then the actuation into the non linear regime of the actuator is no issue for the performance of the speaker element.

Figure 4:
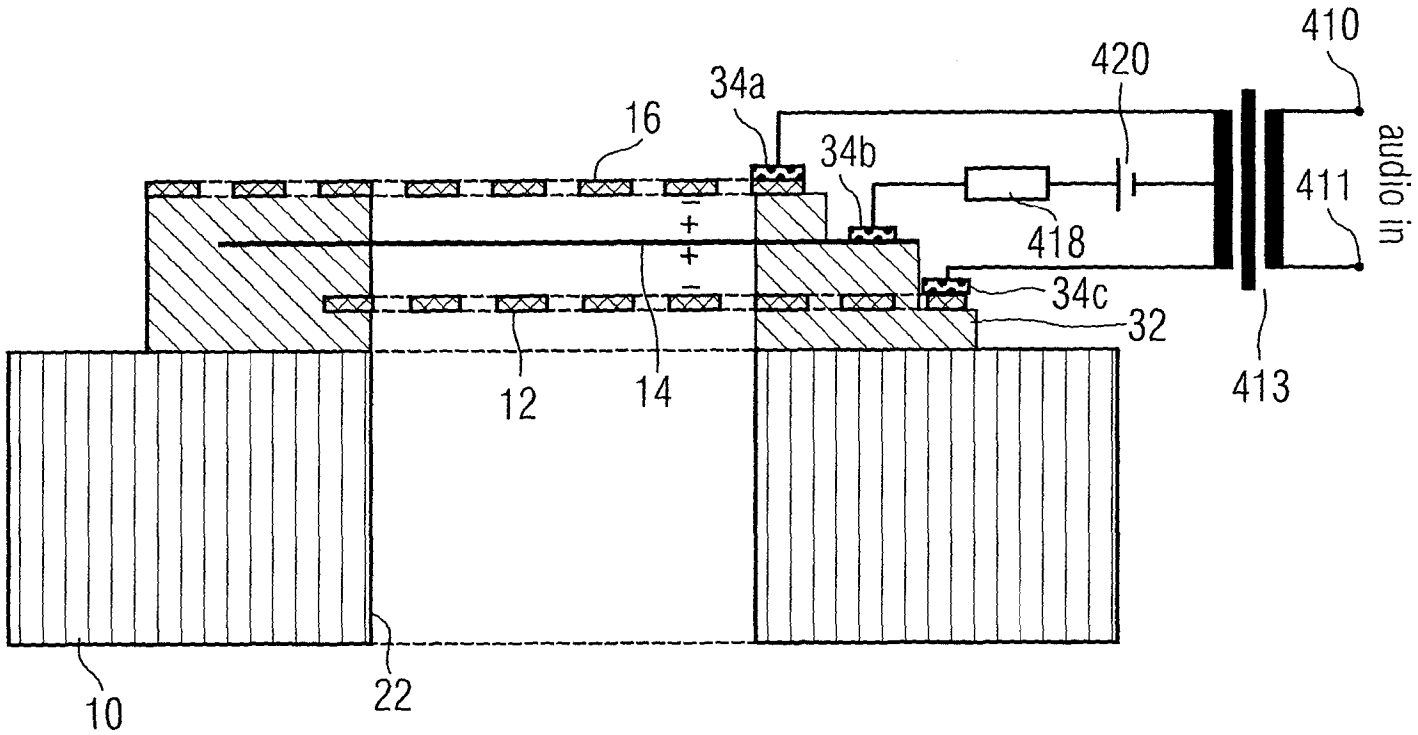
FIG. 4 shows a schematic cross-section through a loudspeaker and a second option for an electric circuit for driving an analog loudspeaker in the analog or digital domain.

FIG. 4 shows another option for a driving circuit of an analog, electrostatic loudspeaker. The driving circuitry illustrated in FIG. 4 implements a push-pull operation for linearizing the loudspeaker when a strong input signal is applied to the loudspeaker. The audio input signal is provided to the driving circuitry via two input ports 410, 411 which are connected to a primary side of a transformer 413. A secondary side of the transformer 413 has three taps, that is, two end taps and one center tap. The two end taps are connected to the first stator 12 and the second stator 16 via the connection pads 34*c*, 34*b*, respectively. The center tap is connected to the membrane 14 via the connection pad 34*b*, a resistor 418 and a DC voltage source 420. The DC voltage source 420 selectively biases the membrane 14 to a positive electrical potential, compared to the first and second stators 12, 16. Thus, when at rest, the membrane 14 is equally attracted by the first and second stators 12, 16, i.e., a balanced state between the electrostatic forces of attraction and a mechanical retroactive force is maintained as long as the audio input signal is zero. In case a time varying audio input signal is applied to the input ports 410, 411, a time-varying voltage is generated within a secondary side of the transformer 413. This leads to a variation of the electrical potentials applied to the first and second stators 12, 16, and thus also to a variation of the forces of attraction, one of the forces becoming weaker, while the other force becomes stronger. This difference of forces of attraction between the membrane 14 and the stators 12, 16 causes the membrane to move and produce a sound wave.

The high ohmic resistor 418 is optional for the analog driving principle since it keeps charge constant on the membrane supporting the linearization for large movement (large movement with same charge increases the capacitance but reduces the voltage). For digital driving this resistor is not needed. As mentioned above with respect to the configuration shown in FIG. 3, the actuation into the non linear regime of the actuator is no issue for the performance of the speaker element when the loudspeaker is operated in the digital domain.

Figure 5:
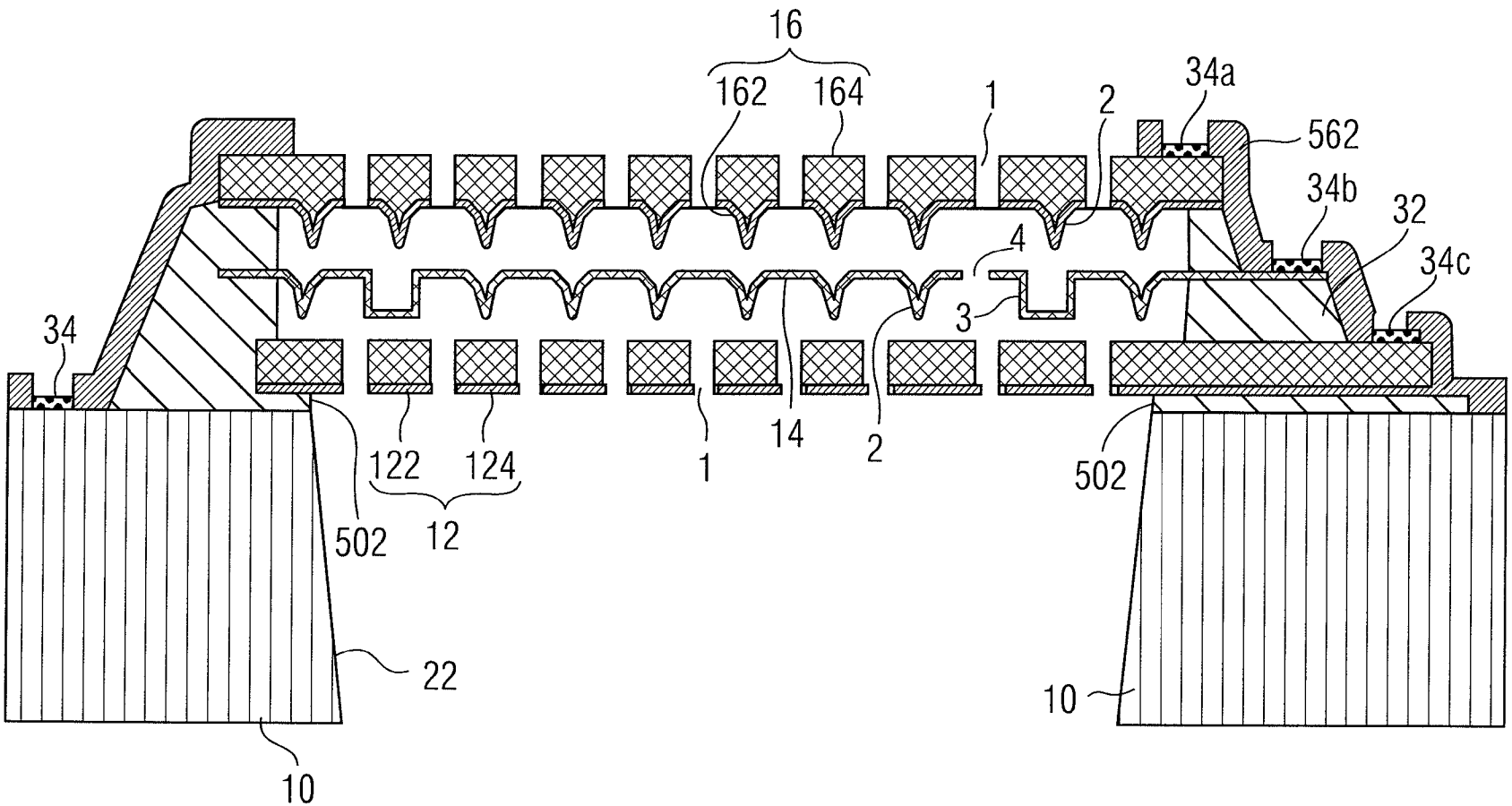
FIG. 5 shows a schematic cross-section through a digital loudspeaker according to an embodiment of the teachings disclosed herein.

FIG. 5 shows a schematic cross-section through a digital micro loudspeaker. Note that the dimensions are not to scale, and shadow lines are not (always) drawn. The digital loudspeaker comprises the substrate 10 as a base on which further layers of the digital loudspeaker are arranged. The substrate 10 comprises a cavity 22 as already explained above. A first layer adjacent to an upper main surface of the substrate 10 is an etch stop layer 502 for reliably stopping an etching of the cavity 22. During the manufacture of the digital loudspeaker, the etch stop layer 502 has been removed within the region defined by the vertical prolongation of the cavity 22. A remainder of the etch stop layer 502 is still present at some regions of the upper main surface of the substrate 10, especially the rim region surrounding the cavity 22. The etch stop layer 502 may be an oxide or tetraethyl orthosilicate (TEOS) and typically has a thickness of 0.5 to 1.0 μm.

The first stator 12 comprises, as shown in the embodiment of FIG. 5, two layers. A first layer is a stoichiometric silicon nitride (SiN) layer 122 with high tensile stress (approximately 1 GPa). The second layer is a highly doped (or highly implanted) polysilicon layer 124. The polysilicon layer 124 is typically thicker than the stoichiometric SiN layer 122. The polysilicon layer 124 also serves as an electrode of a capacitor formed by the first stator 12 and the membrane 14. Both layers of the first stator 12 comprise a plurality of perforation holes or air holes 1 for allowing a relatively rapid exchange of air between the cavity 22 and the volume above the first stator 12. The first stator 12 is mainly provided in the sound transducing region of the digital loudspeaker and also in a region to the right of the cavity 22 which serves as an electrical connection of the first stator 12 to a connection pad 34*c*.

Adjacent to the left of the first stator 12 is a part of the support structure 32. The support structure 32 also extends upwards (away from the substrate 10). The support structure 32 is provided in a substantially angular region surrounding the sound transducing region of the digital loudspeaker. In the embodiment illustrated in FIG. 5, a radially outer surface of the support structure 32 has a frustoconical shape. This frustoconical shape is circumferentially interrupted in a region of the digital loudspeaker that is shown in the right part of FIG. 5, because the electrical connection pads 34*a*-34*c* are provided in this region and require to be spread out. Accordingly, the support structure 32 has a stepped or stair-like shape in this region.

The membrane 14 is situated above the first stator 12. FIG. 5 shows the membrane 14 at a rest position in which the membrane 14 is at a distance from the first stator 12, and therefore does not mechanically contact the first stator 12. The membrane 14 is supported by, or suspended, or fixed to the support structure 32 at a radially outer region of the membrane 14. The membrane 14 may comprise a crystallized silicon layer obtained from deposited amorphous silicon. The crystallization of the previously amorphous silicon occurs during a controlled oven process during the manufacture of the digital loudspeaker. A desired tensile stress of the membrane 14 may be controlled via a temperature budget of the controlled oven process. A phosphor doping of the silicon layer serves to make the membrane 14 electrically conductive.

The membrane 14 comprises a number of structural features such as the anti-sticking bumps 2, the corrugation groove 3, and the pressure equalization hole 4. It will be explained below how these structural features can be obtained during the formation of the membrane 14.

At a distance from the rest position from the membrane 14, the second stator 16 is supported by an upper edge of the support structure 32. This distance corresponds to a gap between the membrane 14 and the second stator 16. In the embodiment shown in FIG. 5, this gap width is substantially the same as the gap width between the first stator 12 and the membrane 14. The support structure 32 is typically deposited during one or more depositing steps. For example, a first depositing step may be performed after the first stator 12 has been formed, and a second depositing step may be performed after the membrane 14 has been formed. The thickness $t_1$, $t_2$ of each layer of the support structure 32 is typically between 1 and 3 μm. In order to have a symmetrical structure of the digital loudspeaker, the layer thicknesses of the two individually deposited layers of the support structure 32 in FIG. 5 are approximately equal. The support structure typically comprises a material selected from the following materials: oxide, TEOS, BPSG (borophosphosilicate glass), or carbon.

The second stator 16 comprises two layers and thus has a structure similar to the structure of the first stator 12. The second stator 16 comprises a stoichiometric silicon nitride layer 162 and a thicker, highly doped (or highly implanted) polysilicon layer 164. The polysilicon layer 164 serves as an electrode of a capacitor formed by the second stator 16 and the membrane 14. The second stator 16 comprises a plurality of air holes 1 and a plurality of anti-sticking bumps 2. Just as the first stator 12, the second stator 16 either has a high rigidity against deflection or is subjected to a pronounced tensile stress, or both. The purpose of a high-rigidity and/or a tensile stress may be to confer stability to the first and second stators 12, 16. The high tensile stress, if present, is mainly provided by the stoichiometric silicon nitride layers 122, 162.

A passivation layer 562 covers parts of the substrate 10 that are still exposed, the support structure 32, as well as selected parts of the first and second stators 12, 16. The passivation layer 562 may comprise a plasma nitride (OxiNitride). As an alternative, the passivation layer 562 may also be obtained from, or on the basis of, polyimide. Some regions of the digital loudspeaker are exempt from the passivation layer 562, such as the connection pads 34*a*-34*c* and the upper surface of the second stator 16 in the sound transducing region.

In the exemplary configuration of FIG. 5 the extension of the membrane region, or sound transducing region, is circular with a diameter of 0.4 mm to 3 mm. Other forms such as square, rectangular, or oval membranes are equally conceivable.

FIG. 6A to FIG. 6E show a schematic layout of a circular micro-loudspeaker during different stages of a manufacturing process thereof. FIGS. 6A to 6E may also be understood as cross-sections through the structure illustrated in FIG. 5 at different vertical positions. Note that FIGS. 6A to 6E show simplified layouts of the structure of the digital loudspeaker.

Figure 6C:
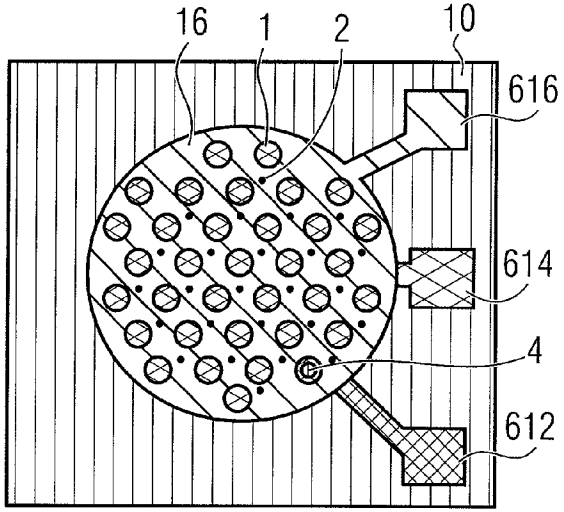
FIGS. 6A to 6E show top views of a digital loudspeaker at different stages of a manufacturing process.
Figure 6B:
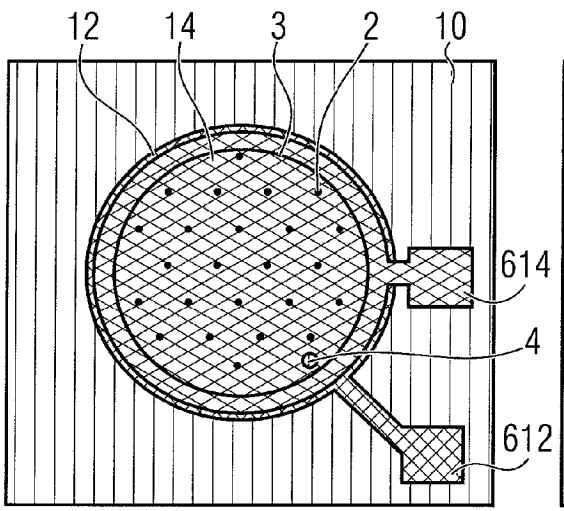
Figure 6A:
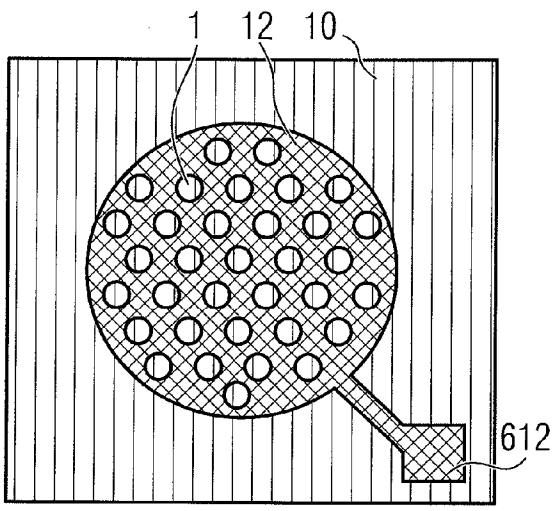

FIG. 6A shows a substrate 10 from above after the definition of the first stator 12 with a connection to the connection pad 34*c* and air holes or perforation holes 1. The first stator 12 is deposited on the substrate 10 with a substantially circular shape. The air holes 1 are, for example, concurrently formed by suitably masking the surface of the substrate during the deposition of the first stator material. The first stator 12 comprises an extension in the lower left direction in FIG. 6A which terminates in a rectangular connection area 612.

FIG. 6B shows the stage subsequent to structuring the membrane 14. The membrane 14 comprises dot-shaped or point-shaped anti-sticking bumps 2 and, for example, one corrugation ring 3 for increasing the sensitivity of the digital loudspeaker. The membrane 14 is extended to the right by a conductive strip which terminates in a rectangular connection area 614. The pressure equalization hole 4 is also formed in the membrane 14. The pressure equalization hole 4 is typically needed to ensure static pressure equalization.

FIG. 6C shows a structured second stator 16 which comprises anti-sticking bumps 2 as well. The second stator 16 is extended to the upper right by an electrically conductive strip terminating in a rectangular connection area 616. Note that the structuring of the support structure 32 is not shown in FIGS. 6A to 6E for the sake of clarity.

Figure 6E:
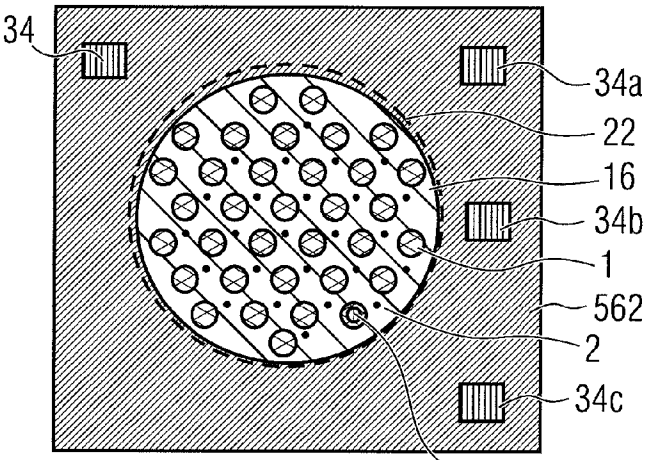
Figure 6D:
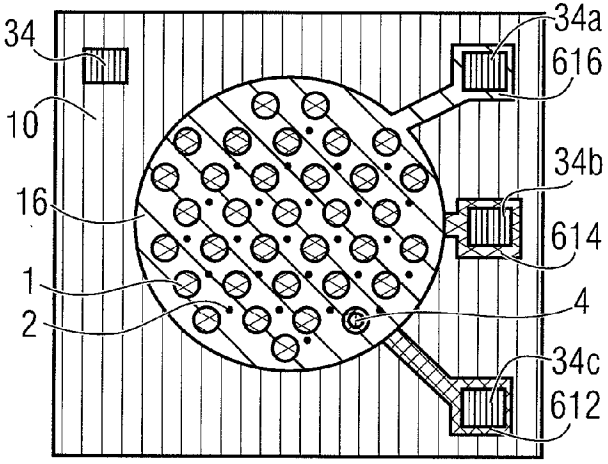

FIG. 6D shows the state of the digital loudspeaker after a metallization has been deposited on the connection areas 612, 614, and 616. Furthermore, a metallization has also been deposited on the substrate 10 which can be seen on the upper left corner of the substrate illustrated in FIG. 6D. These metallizations form the connection pads 34 and 34*a*-34*c* for the substrate 10, the second stator 16, the membrane 14 and the first stator 12, respectively.

FIG. 6E shows the substrate and the structure on the upper main surface of the substrate 10 after the passivation layer 562 has been deposited on the upper surface of the substrate 10 and on the electrically conductive strips that connect the first stator 12, the membrane 14, and the second stator 16 with the connection pads 34*a*, 34*b*, and 34*c*, respectively. Furthermore, a pad opening action has occurred between the states illustrated in FIGS. 6D and 6E. The dashed circle indicates a position of the cavity 22 in the substrate 10, which has been formed by means of a backside etching process. Therefore, it is now possible to see through an air hole 1 within the second stator 16, the pressure equalization hole 4 and one of the plurality of air holes 1 in the first stator 12 all the way to the cavity 22 (lower right area of the circular membrane in FIG. 6E).

Figure 7A:
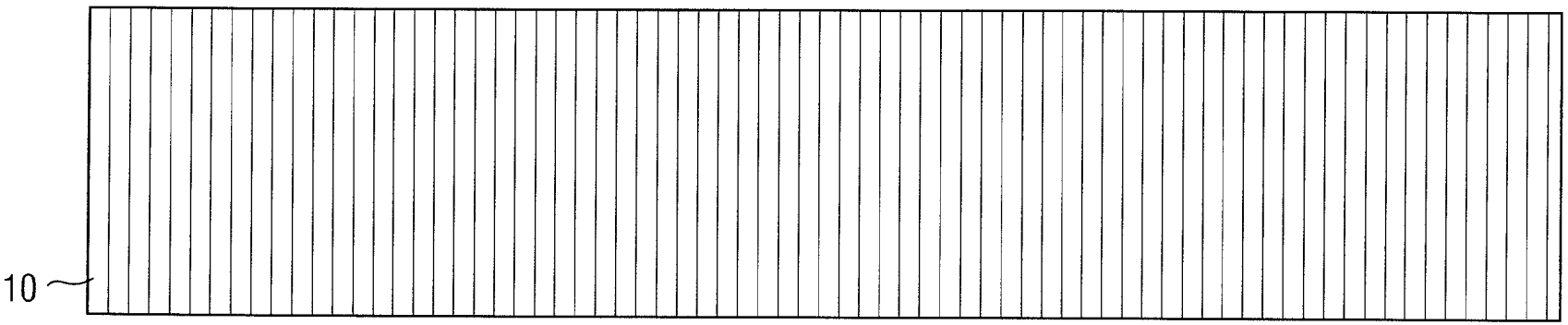
FIGS. 7A to 7O show schematic cross-sections through a substrate and various layers applied to the substrate at different stages of the manufacturing process of the loudspeaker according to the teachings disclosed herein.
Figure 7B:
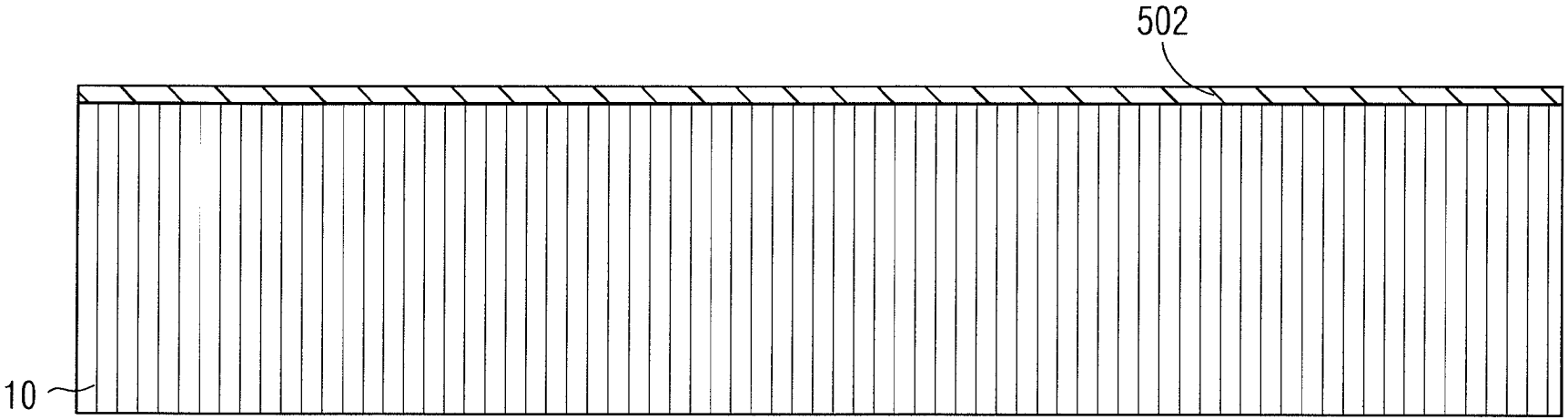
Figure 7C:
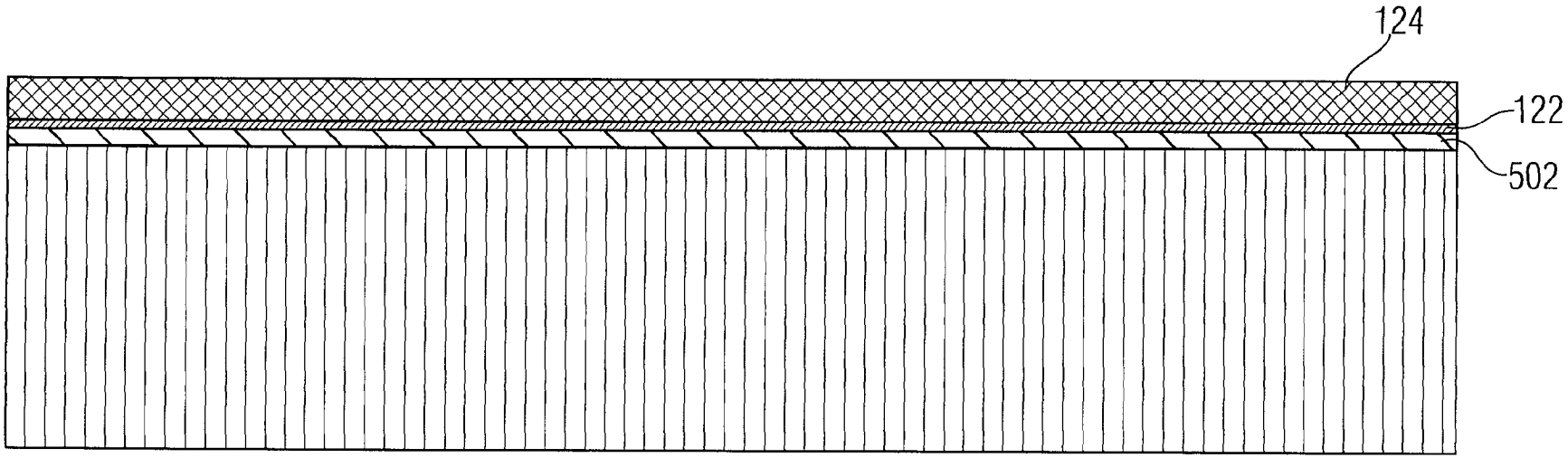
Figure 7D:
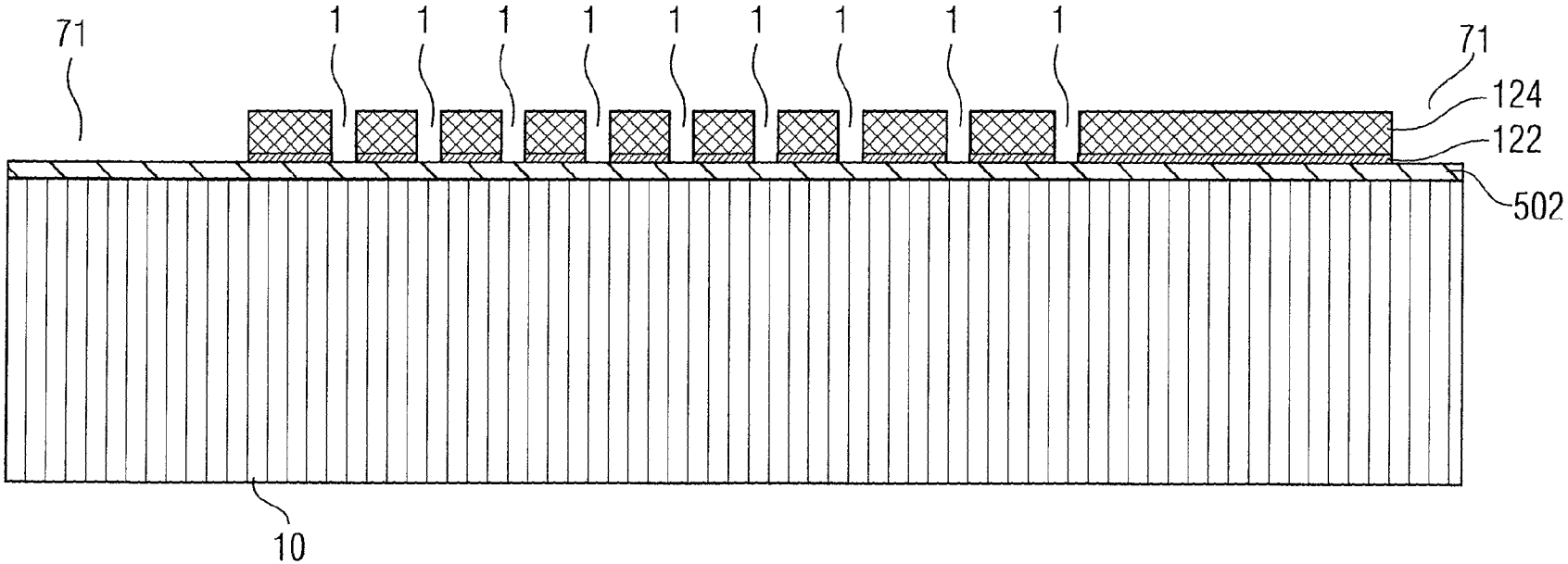
Figure 7E:
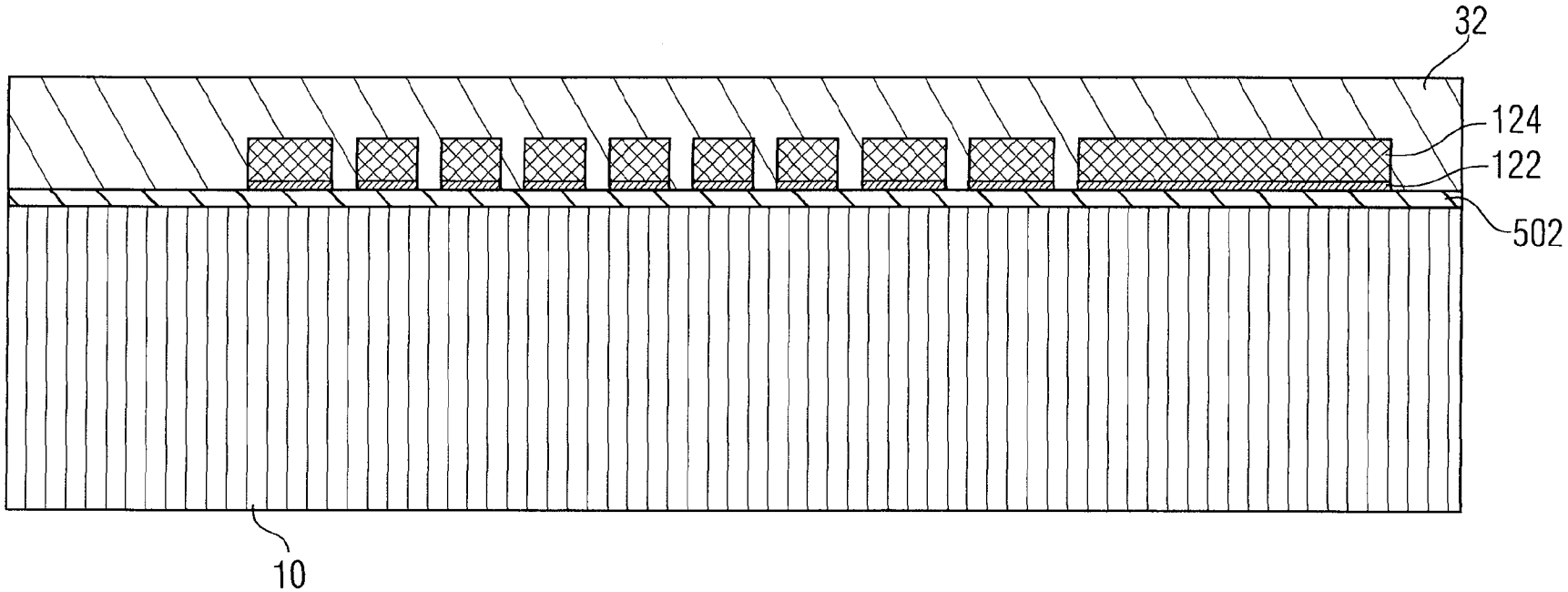
Figure 7F:
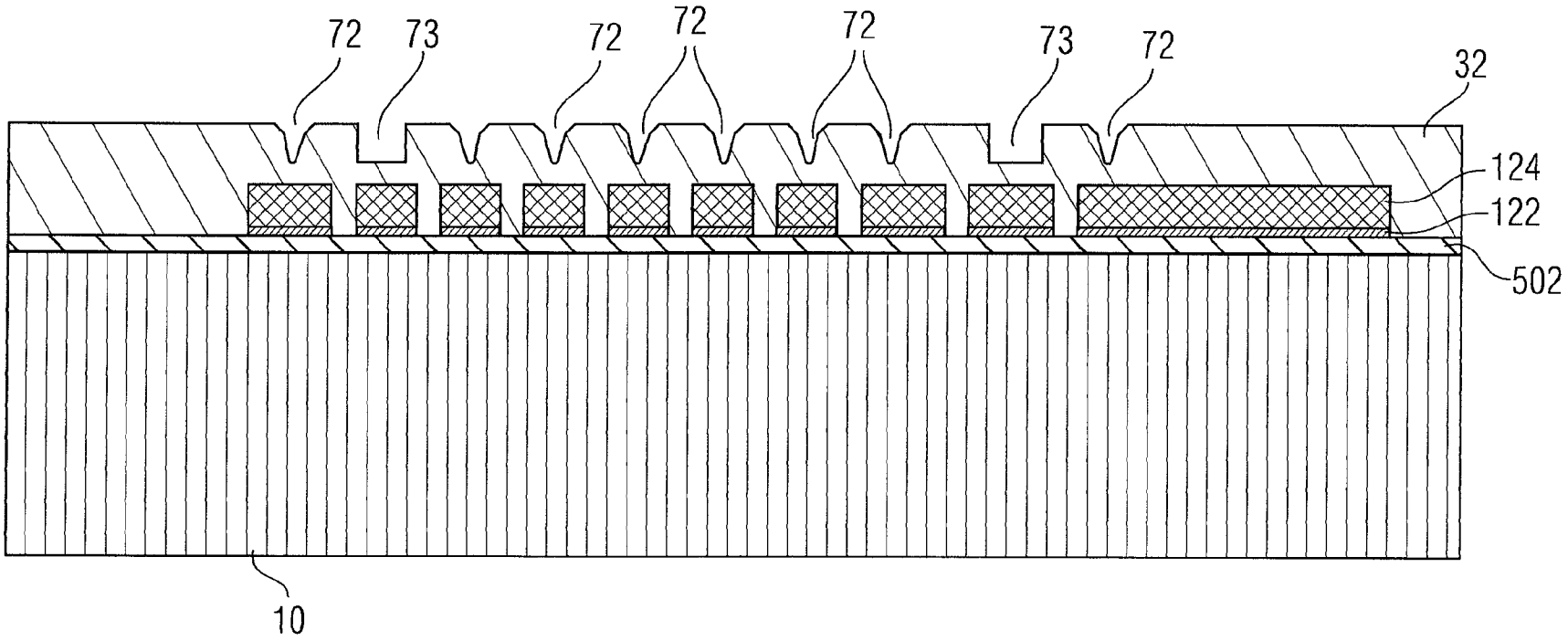
Figure 7G:
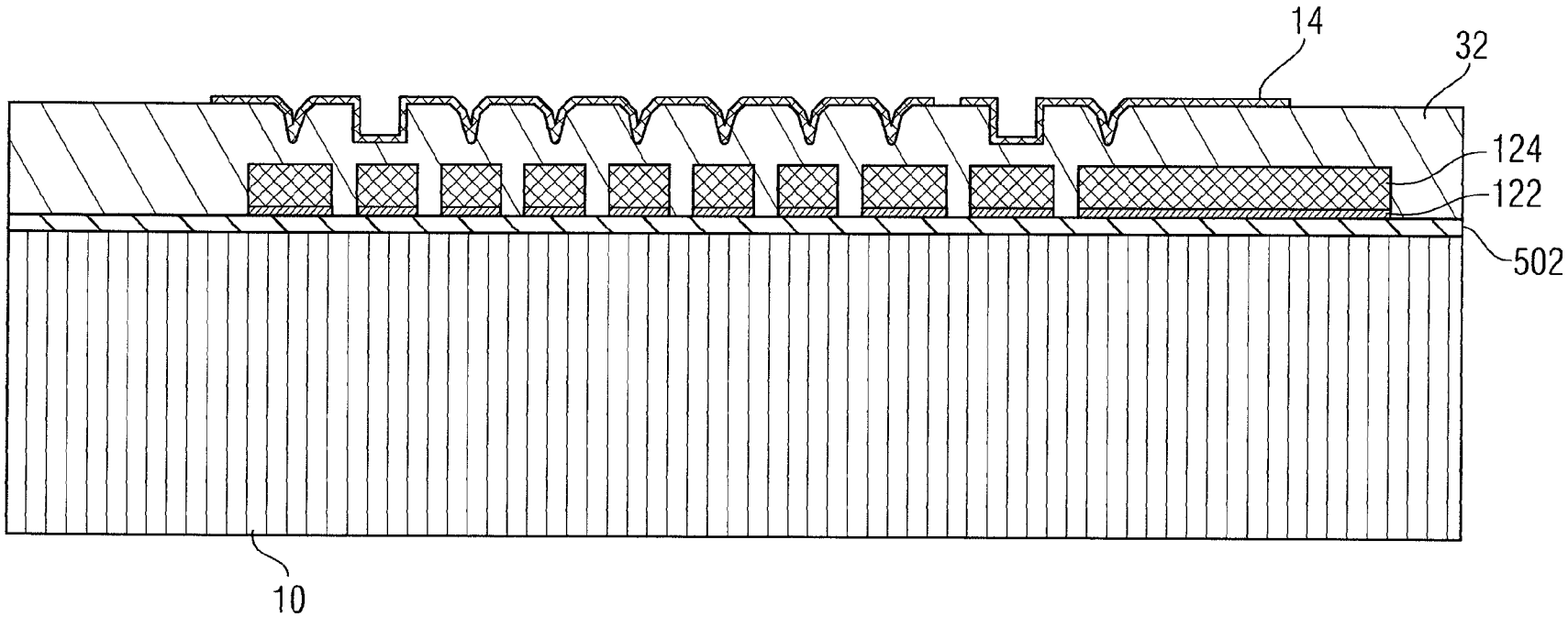
Figure 7H:
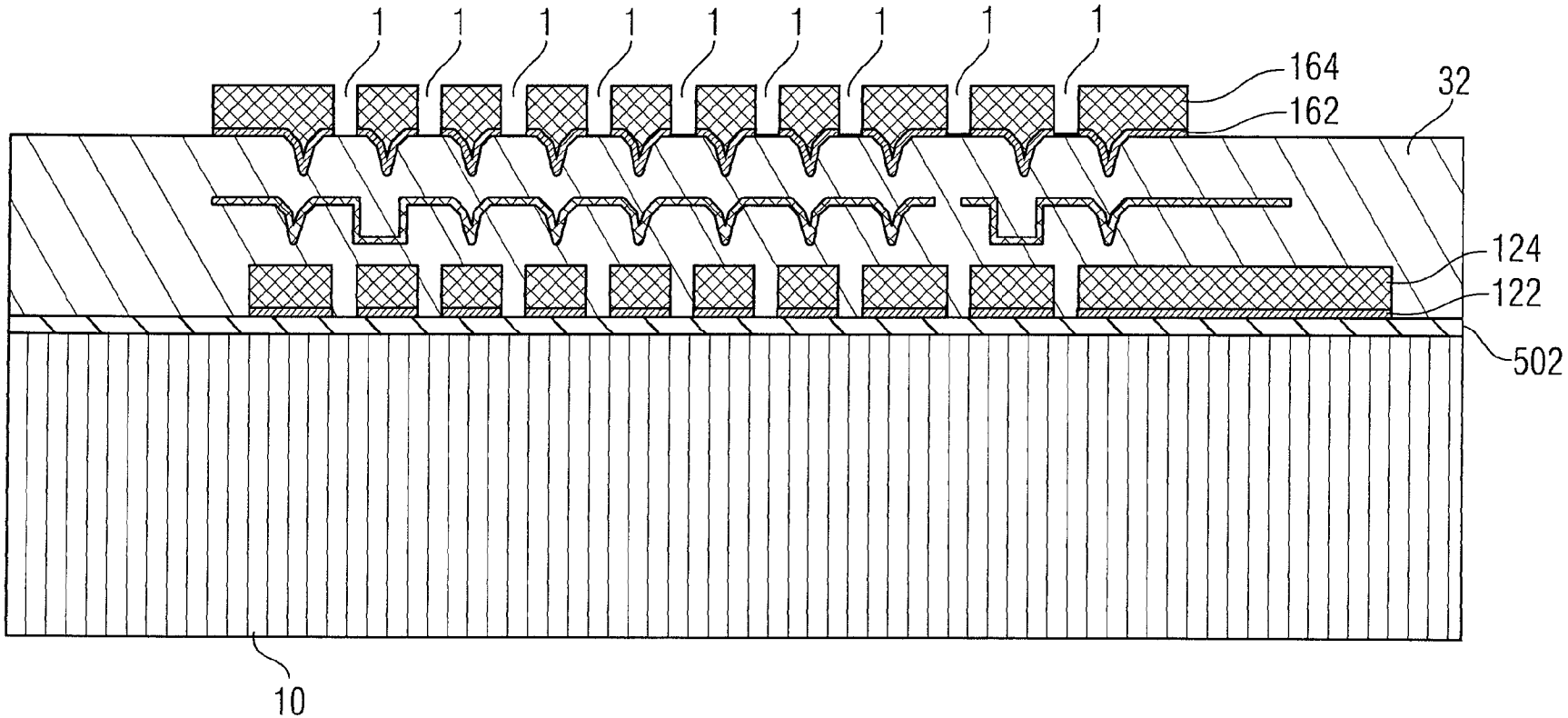
Figure 7I:
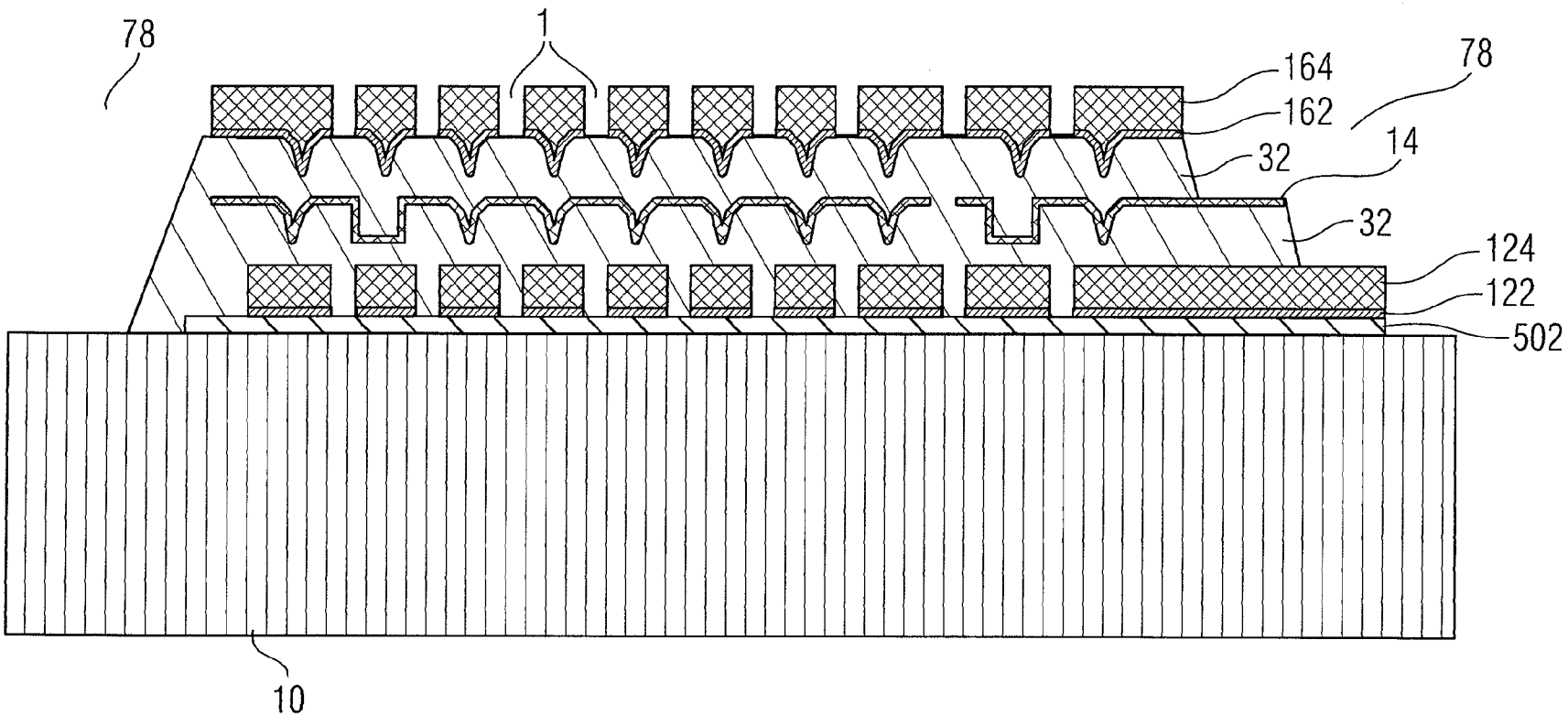
Figure 7J:
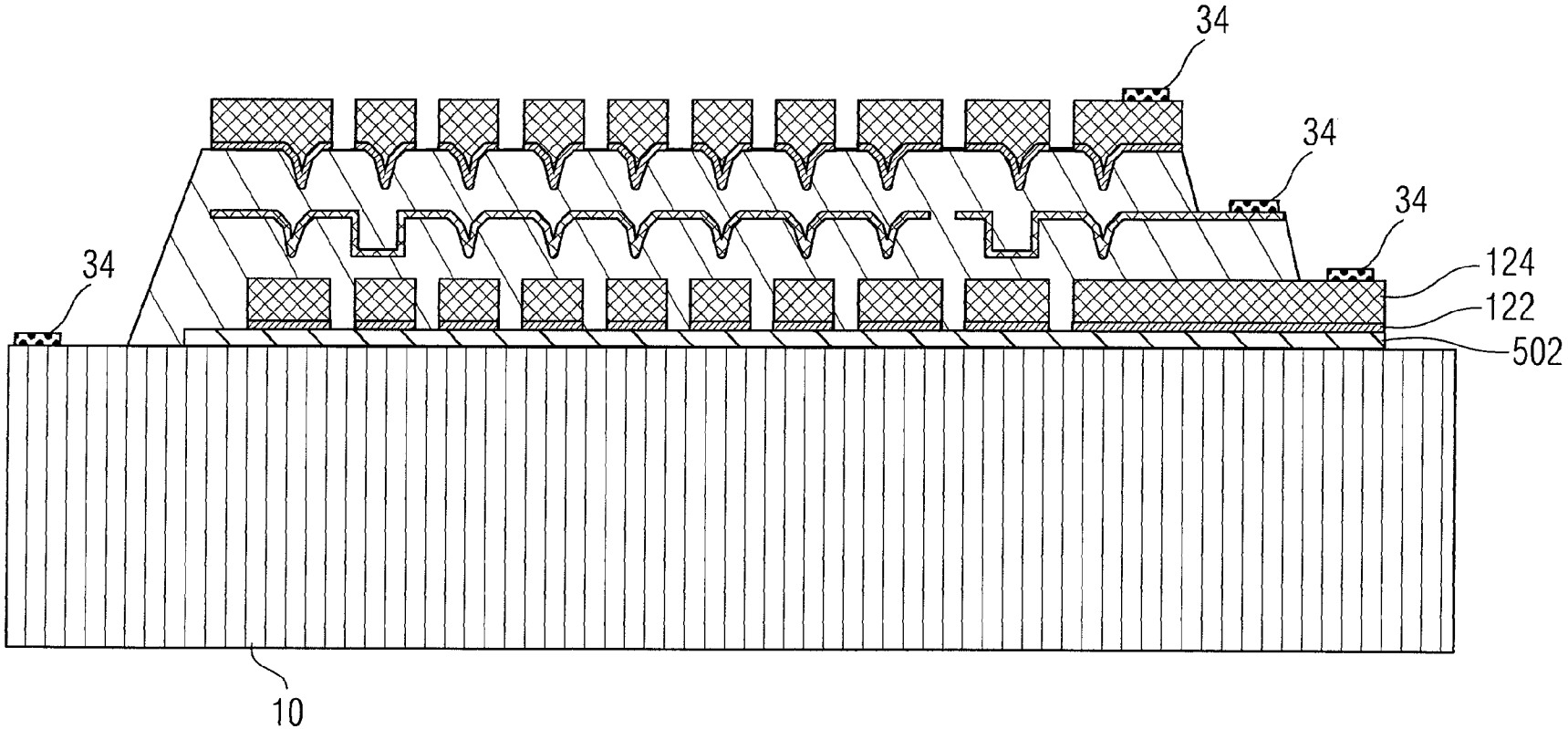
Figure 7K:
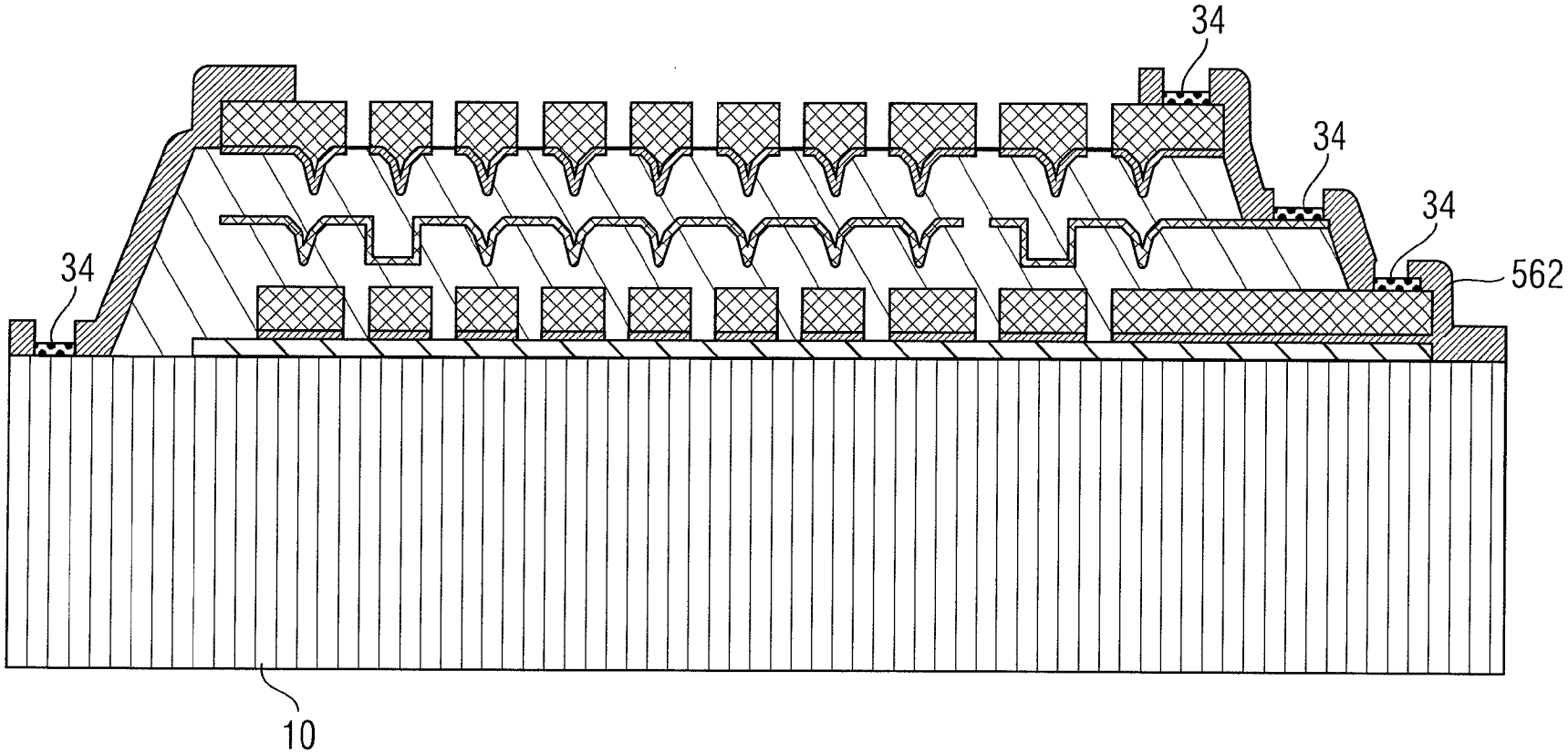
Figure 7L:
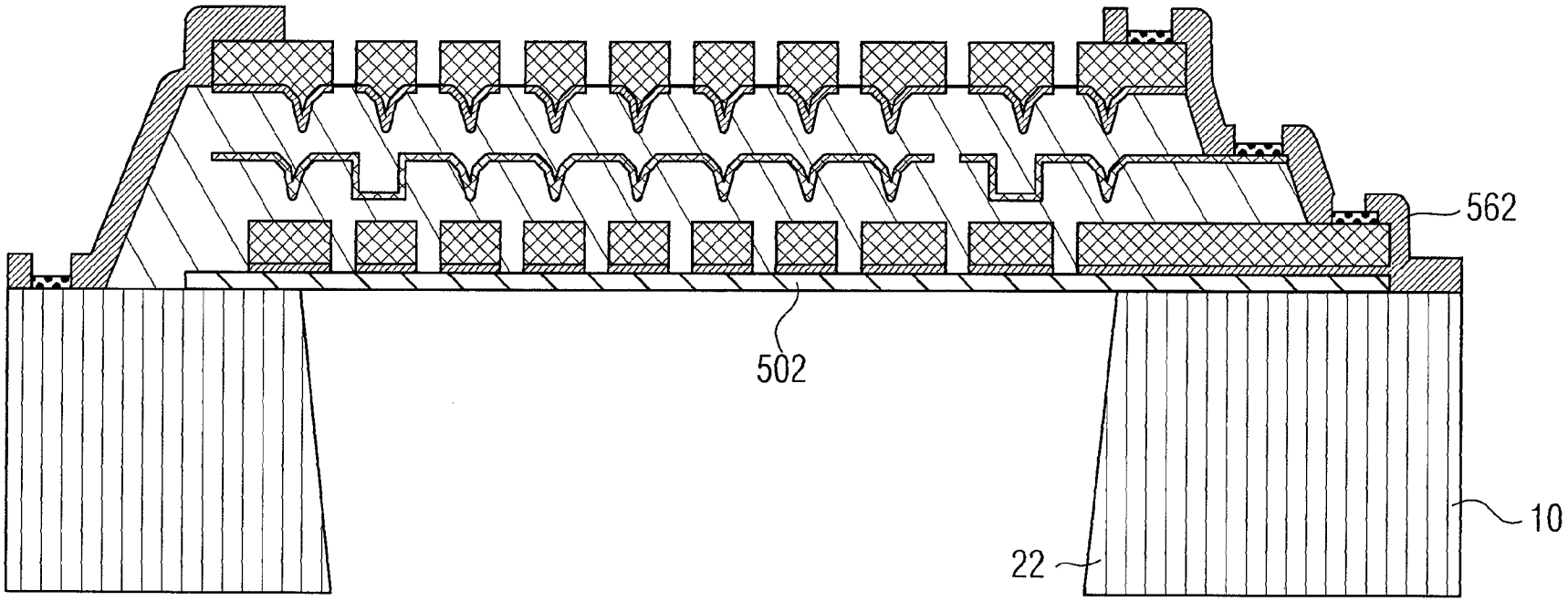
Figure 7M:
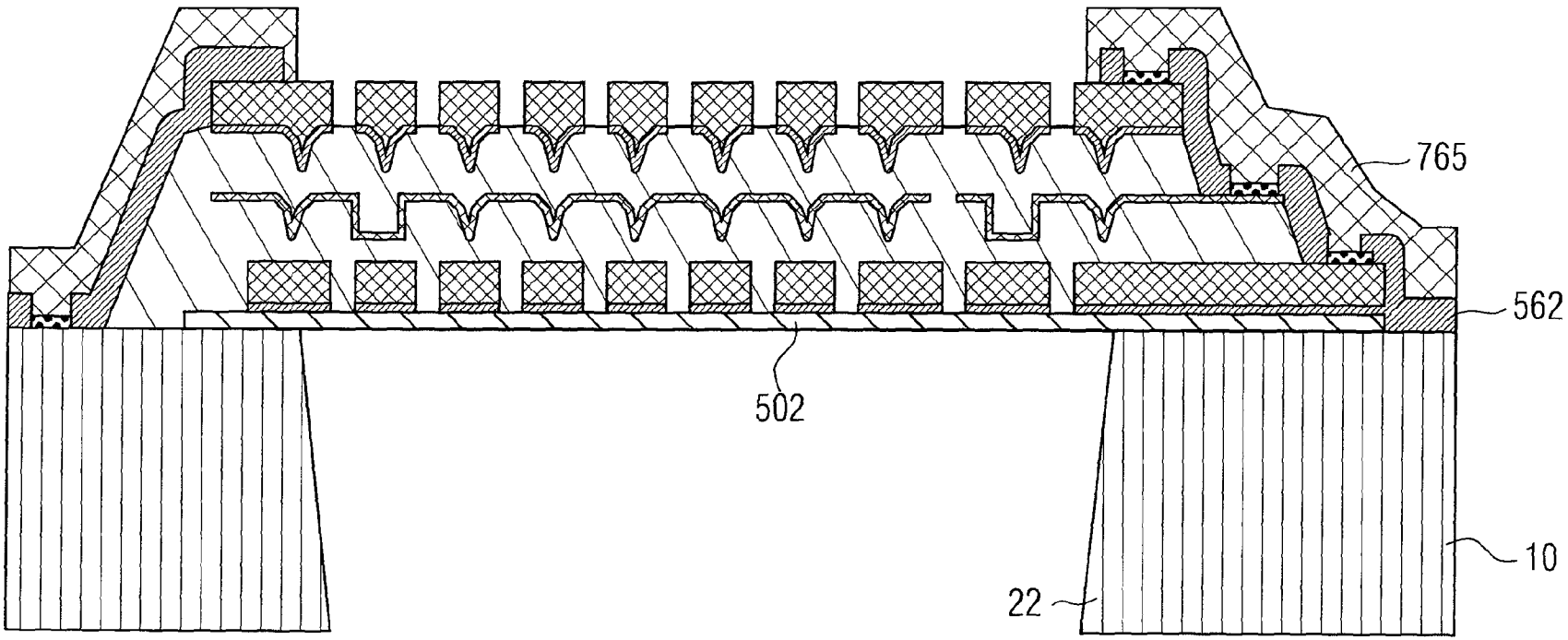
Figure 7N:
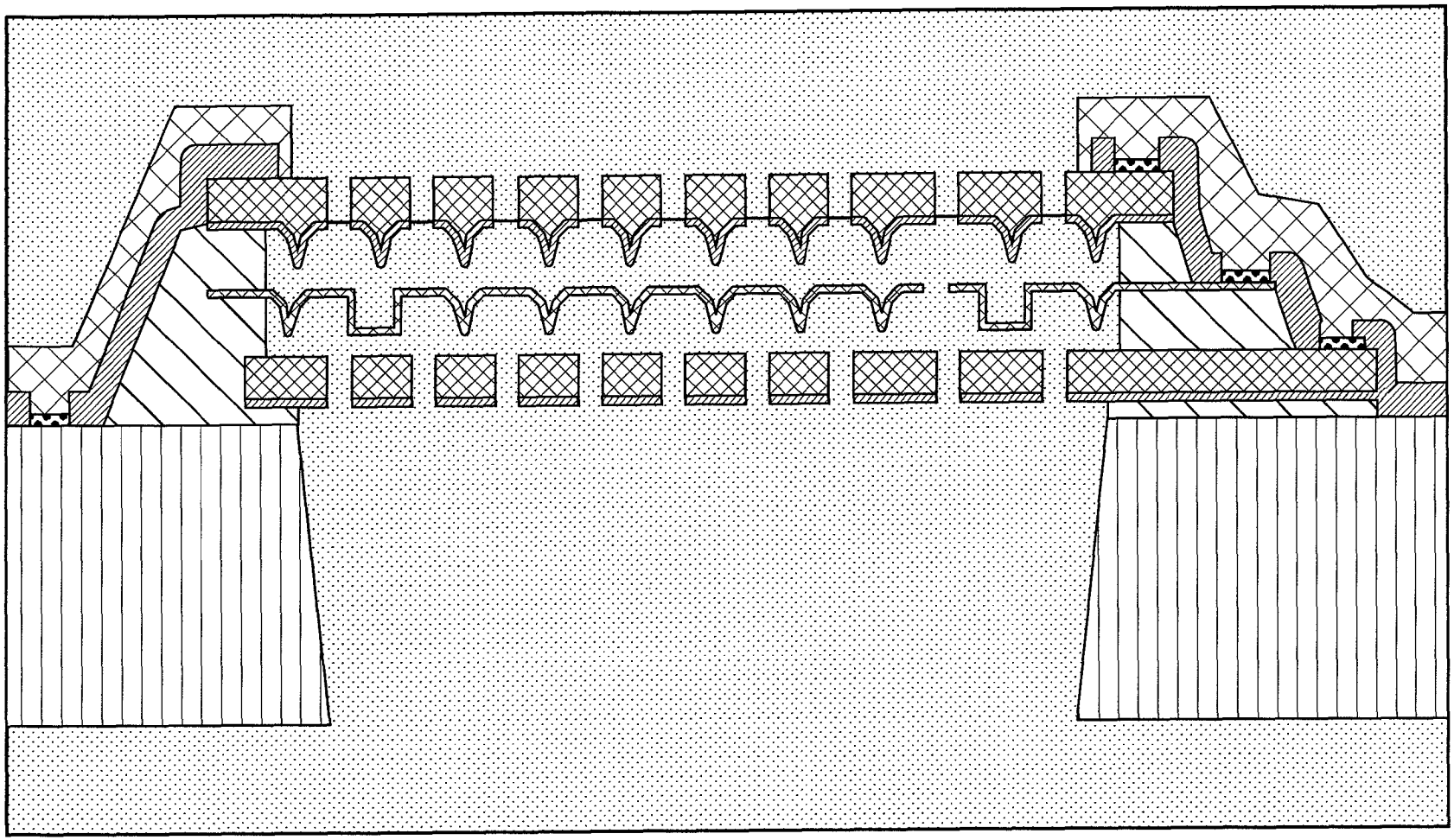
Figure 7O:
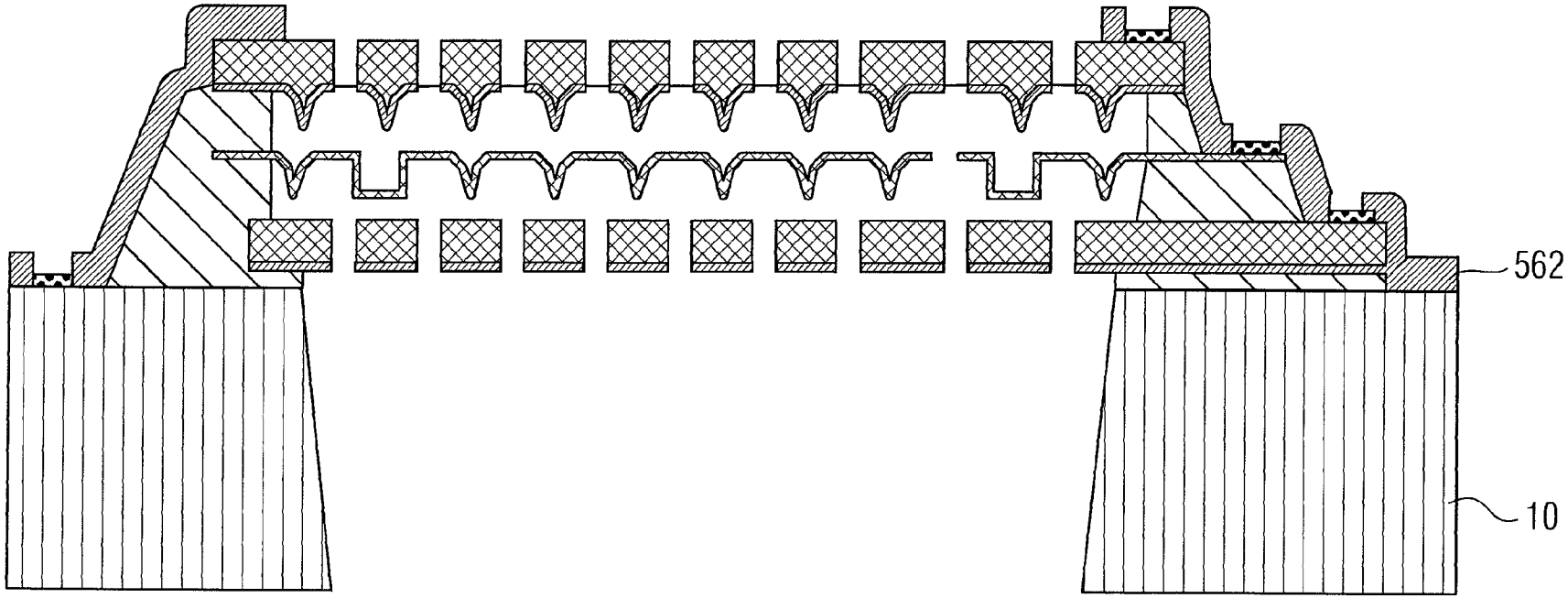

FIGS. 7A to 7O show schematic cross-sections through a portion of a wafer during various stages or steps of a manufacturing process of the digital loudspeaker according to the teachings disclosed herein.

FIG. 7A shows the substrate at the beginning of the manufacturing process. The substrate 10 may be a silicon wafer in which silicon is arranged in a mono-crystalline structure. At least the upper main surface of the wafer and thus the substrate 10 has been processed by means of polishing and/or etching processes, in order to obtain a smooth surface. Typically, the lower main surface of the substrate has been processed in the same manner.

In FIG. 7B a lower etch stop layer 502 has been deposited at the upper main surface of the substrate 10. The lower etch stop layer 502 ensures a reliable stop of an etching process for forming the cavity 22 which occurs at a later stage of the manufacturing process. The lower etch stop layer 502 is typically made from an oxide or TEOS. Its thickness is typically between 0.5 and 1 μm.

FIG. 7C shows a schematic cross-section of the wafer after two layers for the lower or first stator 12 have been deposited on the lower etch stop layer 502. It is desired that the first stator 12 has a relatively high rigidity with respect to deflection and/or is subjected to a pronounced tensile stress in order to attain the required degree of stability for its intended purpose as a stator in the digital loudspeaker. For example, the first stator 12 should be sufficiently rigid so that it does not start to oscillate under the influence of air that is agitated by the membrane 14 and flows through the plurality of air holes 1 which are formed in the first stator 12 at a later stage of the manufacturing process. Furthermore, the membrane 14 is designed to mechanically contact the first stator 12 periodically. The first stator 12 should be sufficiently rigid to avoid self bending during capacitive actuation of the membrane (self bending should be less than 10% of the actuation of the membrane). One way to achieve these desired specifications is to build the first stator 12 from a combination of a stoichiometric silicon nitride layer 122 with high tensile stress (approximately 1 GPa) and a thicker, highly implanted polysilicon layer 124.

FIG. 7D shows a schematic cross-section of the wafer subsequent to a lithography of the first stator 12 (formed by the stoichiometric silicon nitride layer 122 and the polysilicon layer 124) and also subsequent to a structuring of these stator layers 122, 124 down to the lower etch stop layer 502. A recess 71 has been formed to the left and the right of the stator layers 122, 124. Note that the recess 71 typically surrounds the stator layer 122, 124, as the first stator 12 is, for example, circular or square. At the same time, a plurality of air holes 1 is formed in the first stator layers 122, 124.

In FIG. 7E, the sacrificial layer 32 has been deposited and possibly tempered. The sacrificial layer 32 defines the gap width between the first stator 12 and the membrane 14. The thickness of the sacrificial layer 32 is typically between 1 μm and 3 μm. The sacrificial layer 32 may be made from oxide, TEOS, BPSG, or carbon. Note that, at a later stage, at least some parts of the sacrificial layer 32 will form the support structure in the completed digital loudspeaker (see, e.g., FIG. 5). Therefore, the same reference sign "32" indicates both, the sacrificial layer and the support structure.

During the depositing of the sacrificial layer 32, a process can be inserted to perform a lithography of a precursor form of the anti-sticking bumps 2 and of the corrugation groove 3. The precursor forms of the anti-sticking bumps 2 are given by, e.g., cone shaped recesses 72, (see FIG. 7F) while the precursor form of the corrugation groove 3 is given by an annular groove 73. This may be done during a single step. The precursor forms 72, 73 may either be obtained by etching the sacrificial layer 32 or by applying a mask during the depositing of the sacrificial layer 32. The creation of the precursor forms 72, 73 is, however, optional and may be skipped if the future membrane 14 does not comprise the anti-sticking bumps 2 and the corrugation groove 3.

FIG. 7G corresponds to a process stage after the membrane layer 14 has been deposited on top of the sacrificial layer 32. The membrane layer 14 may be deposited as amorphous silicon, subsequently implanted or doped with phosphor, and then crystallized in a controlled oven process. By means of the temperature budget, the tensile stress within the membrane layer 14 can be controlled. At the same time, the doping also serves to render the membrane electrically conducting. Subsequent to the controlled oven process, a lithography is performed on the membrane layer 14 and thus the membrane layer 14 is structured down to the sacrificial layer 32, as can be seen on the left and the right of membrane layer 14. The lithography on the membrane layer 14 also serves to form the pressure equalization hole 4.

FIG. 7H shows the wafer after the following steps have been performed. Another partial layer of the sacrificial layer 32 has been deposited on top of the membrane layer 14 and on the already deposited sacrificial layer 32. Possibly, the additional layer of the sacrificial layer 32 has been tempered. The additional sacrificial layer 32 defines the future gap width between the membrane 14 and the second stator 16. The thickness $t_2$ of the additional sacrificial layer is typically between 1 μm and 3 μm, and is typically chosen to be the same as the thickness $t_1$ of the previously deposited sacrificial layer 32 between the first stator 12 and the membrane 14, for the sake of symmetry. Again, the additional sacrificial layer 32 may comprise an oxide, TEOS, BPSG, or carbon.

In a manner similar to what has been described in the context of FIG. 7F, a process can be inserted during the depositing of the additional sacrificial layer 32, in order to perform a lithography of the precursor forms for the anti-sticking bumps 2. The depositing of the additional sacrificial layer 32 and the definition of the precursor forms may be performed during a single step.

Subsequently, the layer for the second stator 16 is deposited. Again, a combination of a stoichiometric silicon nitride layer 162 with high tensile stress (approximately 1 GPa) and a thicker, high-implanted polysilicon layer 164 may be used. Thus, the second stator 16 has a high stability due to a high rigidity against deflection and is subjected to a pronounced tensile stress. The polysilicon layer 164 also serves as an electrode for a capacitor formed by the second stator 16 and the membrane 14.

A lithography is then performed on the second stator 16 and thus the second stator layers 162, 164 are structured down to the sacrificial layer 32.

FIG. 7I shows how the oxide layers of the sacrificial layer 32 have been structured to expose the connection areas 612, 614, 616 (see FIGS. 6A to 6E) and the substrate 10.

FIG. 7J shows the wafer after the connection pads 34 have been formed on the connection areas 612, 614, and 616. A connection pad 34 has also been formed on the wafer 10 so that the wafer 10 may be connected to a defined electrical potential, for example, in order to electrically ground the substrate 10. The connection pads 34 are formed by performing a lithography on the exposed surfaces of the wafer of FIG. 7I and by then performing a metallization in the areas that are still exposed after the lithography. Electrically conducting strips or lines may also be formed by means of the metallization.

The result of a depositing step of a passivation layer 562 is shown in FIG. 7K. The passivation layer 562 may consist of a plasma nitride (OxiNitride), but could also be obtained from polyimide. In order to provide an access to the connection pads 34, the passivation layer 562 is etched in the corresponding areas wherein the spatial action of the etching is controlled by previously performed lithography on the passivation layer 562. A so-called MEMS area is also defined by the lithography and exposed by the subsequent etching of the passivation layer 562. The MEMS area is basically the sound transducing region, i.e., the area above and beneath the deflecting portion of the future membrane 14.

Subsequent to the intermediate process results illustrated in FIG. 7K, the substrate 10 may optionally be thinned. Then, backside masking is defined by means of either a photo resist, or an oxide mask. A backside mask controls a backside etching process by means of which the cavity 22 is created. This etching is intended to stop at the lower etch stop layer 502. The etching may be a directed, isotropic dry etching process (e.g., Bosch Process). Alternatively, an anisotropic or isotropic wet etching process with a suitable mask design is also possible. The result of these steps is illustrated in FIG. 7L.

As can be seen in FIG. 7M, the area outside of the MEMS area is protected by means of a photo resist 765 at the front side of the wafer before the subsequent steps are performed.

Then, as illustrated in FIG. 7N, the sacrificial layer 32 and the lower etch stop layer 502 are removed by means of an etching process via the cavity 22 and the photo resist 765. The etching process is adapted to act on the employed sacrificial layer 32 and has a high selectivity against the membrane layer 14 and the stator layers 122, 124, 162, and 164. At the same time, the control of the etching process should ensure that the different layers do not stick to each other. The sacrificial layers 32 may be etched by a hydrofluoric acid and sufficiently rinsed. Then, as illustrated in FIG. 7O, the photo resist 765 may be removed, the entire wafer rinsed one more time with appropriate solvents, and dried. Amongst others, the presence of the anti-sticking bumps 2 at the membrane layer 14 and a second stator layer 16 prevents a sticking of the MEMS areas during the drying process.

FIG. 7O substantially corresponds to FIG. 5 and shows the end product of a process for creating the digital loudspeaker according to the teachings disclosed herein. The digital loudspeaker may now be electrically connected via the connection pads 34*a*-34*c* with a driving circuitry.

Since the manufacturing process of the digital loudspeaker according to FIGS. 7A to 7O is performed in the context of a wafer process, large groups of digital loudspeakers of basic digital loudspeaker elements can be combined relatively easily in order to either, increase a power of sound radiation, or to provide for a desired amplitude resolution of the audio signal. In the latter case, the amplitude of the audio signal controls how many basic loudspeaker elements of a loudspeaker array are driven at a given time: only a few basic loudspeaker elements are driven if the audio signal has a relatively low amplitude. At a different time, a large number or even all basic digital loudspeaker elements may be driven if the audio signal has a relatively large amplitude. In this manner, an array of several basic digital loudspeaker elements may approximate the wave form of the original audio signal so that a remaining difference is possibly imperceptible to a listener.

Figure 8:
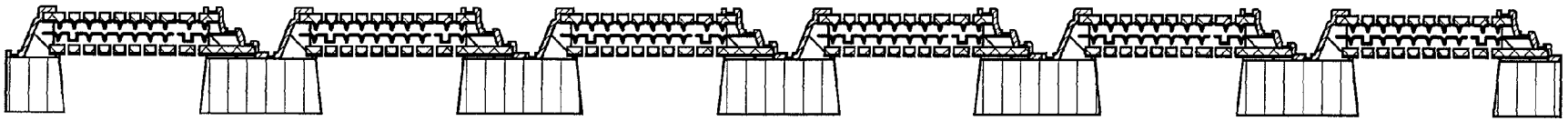
FIG. 8 shows a schematic cross-section through an array of digital loudspeakers.

FIG. 8 illustrates a cross-section through an array of several basic loudspeaker elements that are formed on a common wafer or substrate 10. The basic loudspeaker elements of the array may, for example, be arranged in a rectangular or square manner with m lines and n columns, thus forming an m×n array, where m>1 and/or n>1. A typical array may comprise several hundreds of basic digital loudspeaker elements up to hundreds of thousands basic digital loudspeaker elements. The number of basic digital loudspeaker elements depends on the desired resolution, the desired sound pressure level, and the intended frequency range of a digital loudspeaker using the array of basic digital loudspeaker elements.

Figure 9:
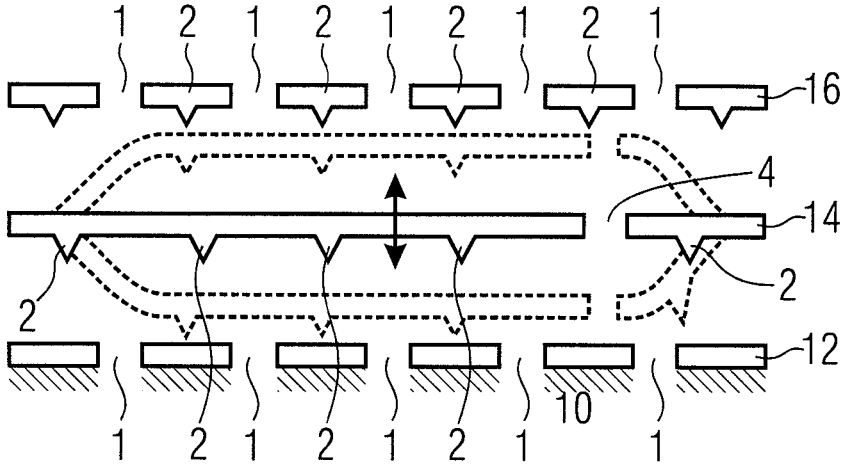
FIG. 9 is a conceptual drawing of a cross-section through a digital loudspeaker according to the teachings disclosed herein illustrating an aspect of the configuration and operation of the digital loudspeaker.

FIG. 9 illustrates the concept of operation of the digital loudspeaker according to the teachings disclosed herein. The membrane 14 is arranged between the first stator 12 and the second stator 16, when the membrane 14 is at its rest position. The membrane 14 in its rest position is drawn in a continuous line. When different electrical potentials are applied to the first stator 12, the membrane 14, and the second stator 16, the membrane 14 may be attracted to, e.g., the second stator 16, that is, the membrane 14 is pulled up due to an electrostatic force between the membrane 14 and the second stator 16. In addition, a repelling electrostatic force may be created between the membrane 14 and the first stator 12, if a driving circuitry connected to the digital loudspeaker applies an electrical charge to the membrane 14 and the first stator 12 that leads to an electrical charge of the same sign within the membrane 14 and the first stator 12 (either both are positively charged, or both are negatively charged). According to the teachings disclosed herein, the central portion of the membrane 14 is pulled upwards until it contacts the second stator 16 (the membrane 14 in the upper end position is illustrated in dashed line in FIG. 9). When the central portion of the membrane 14 mechanically contacts a second stator 16, a stable state has been reached because the electrostatic force of attraction between the membrane 14 and the second stator 16 maintains the central portion of the membrane 14 in this position as long as the electrostatic force persists. Therefore, a drive signal provided by a driving circuitry simply has to ensure that a sufficiently high voltage is applied between the membrane 14 and at least one of the two stators 12, 16.

The central portion of the membrane 14 does not mechanically contact a flat area of the second stator 16, but rather the tips of the anti-sticking bumps 2, only, which are in a region of the second stator 16 corresponding to the central portion of the membrane 14. In the exemplary configuration shown in FIG. 9, the membrane 14 does not mechanically contact the leftmost anti-sticking bump and the rightmost anti-sticking bump of the second stator 16.

The same is basically true when the membrane 14 is pulled downward towards the first stator 12 (the membrane 14 in the lower end position is drawn in dashed line in FIG. 9). In this case, the anti-sticking bumps 2 are provided at a lower main surface of the membrane 14. In both cases, the anti-sticking bumps 2 prevent that an adhesive force between the membrane 14 and either, the second stator 16 or the first stator 12 becomes too large, which would prevent membrane 14 from returning to its central rest position, thus, potentially rendering the digital loudspeaker unusable.

The anti-sticking bumps formed on the lower main surfaces of the second stator 16 and the membrane 14 form elevations that protrude from the surfaces. Thus, the membrane mechanically contacts the first stator 12 and the second stator 16 substantially at least one of these elevations, i.e., the anti-sticking bump(s).

Figure 10:
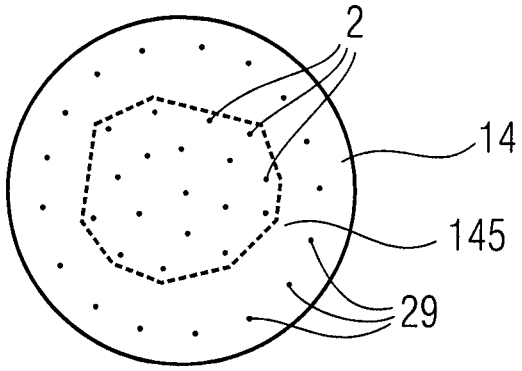
FIG. 10 is a schematic top view of the membrane of a digital loudspeaker, illustrating an option for defining a contact area between the membrane and either the first stator or the second stator.

FIG. 10 shows a schematic top view of the membrane 14 when it is in its first end position, i.e., when the membrane mechanically contacts the first stator 12. The anti-sticking bumps 2 of the membrane 14 can be subdivided into two groups: a first group of the anti-sticking bumps 2 participates in the mechanical contact between the membrane 14 and the first stator 12. These participating anti-sticking bumps or protruding elevations 2 are contained in a circumscribing area 145. The circumscribing area 145 is defined by connecting the outermost anti-sticking bumps that participate in the mechanical contact so that a circumscribing area 145 typically is a polygon. In the alternative, the circumscribing area 145 could be a circumscribing circle or a circumscribing ellipse. Outside of this circumscribing area 145, there are only non-participating anti-sticking bumps 29. Note that some of the non-participating anti-sticking bumps 29 could also lie within the circumscribing area 145. However, if there is a participating anti-sticking bump 2 that is situated farther out within the circumscribing area 145, the definition of the circumscribing area 145 is not altered by the presence of the non-participating anti-sticking bump(s) 29. Other definitions of the circumscribing area 145 may also be employed.

According to an optional aspect of the teachings disclosed herein, the mechanical contact between the membrane 14 and the first stator 12 or the second stator 16, while being in the first position or in the second position, respectively, occurs within a circumscribing area being between 30% and 90% of a total free area of the membrane. The circumscribing area 145 comprises the contact spot or the contact spots (i.e., the participating anti-sticking bumps 2), between the membrane and the first stator 12, or the second stator 16, respectively. The total area of the membrane is typically the area defined by the free volumes above and beneath the membrane 14. Thus, the total area of the membrane 14 excludes any circumferential areas that are sandwiched within the support structure 32, for example, according to this definition.

Figure 11A:
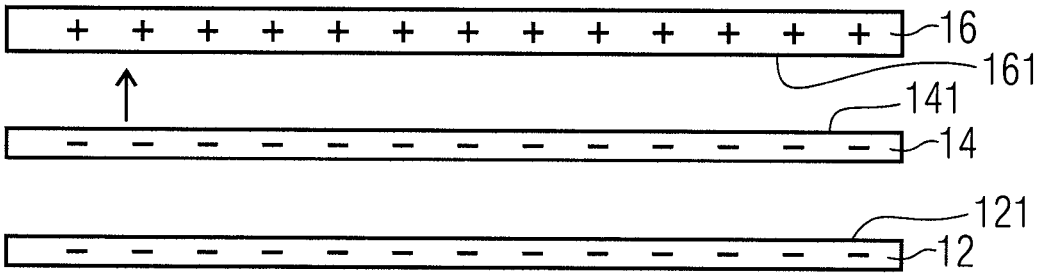
FIGS. 11A and 11B are conceptual drawings of a schematic cross-section of functional elements of a digital loudspeaker according to the teachings disclosed herein in two different states of excitation.
Figure 11B:
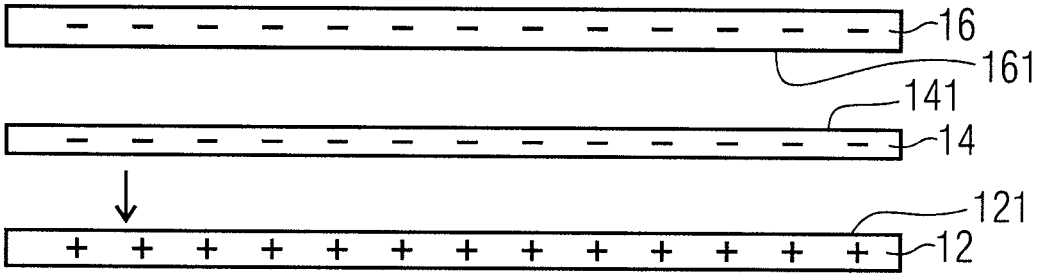

FIGS. 11A and 11B illustrate a method for operating the digital loudspeaker. In FIG. 11A, both the membrane 14 and the first stator 12 are charged with a negative electrical charge, whereas in contrast, the second stator 16 is charged with a positive electrical charge. This is achieved by applying a first electrical potential to the first stator 12, applying a second electrical potential to the second stator 16, and applying a third electrical potential to the membrane 14. Typically, the first, second, and third electrical potentials are different to each other. A difference between the first electrical potential, the second electrical potential, and the third electrical potential causes the membrane 14 to be attracted to the second stator 16, until it reaches a second end position in which the membrane 14 mechanically contacts the second stator 16. The mechanical contact between the membrane 14 and the second stator 16 involves an upper main surface 141 of the membrane 14, and a lower main surface 161 of a second stator 16.

FIG. 11B shows the digital loudspeaker when membrane 14 is attracted by the first stator 12. The membrane 14 then mechanically contacts the first stator 12 at an upper main surface 121.

According to an optional aspect of a method for operating a digital loudspeaker, at least one of the first electrical potential, the second electrical potential, and the third electrical potential may vary over time with a frequency that substantially corresponds to a resonance frequency of the membrane 14. A mechanical resonance frequency of the membrane 14 may be relatively high, well above the audible frequency range of a human being. However, a digital loudspeaker may be operated so that the sound wave is created from a superposition of many small pressure pulses that are spatially and/or temporally distributed. Thus, the audio signal may be reconstructed by such a superposition if the driving signals for an array of basic digital loudspeaker elements are appropriately controlled by, for example, means of an array controller.

Figure 12:
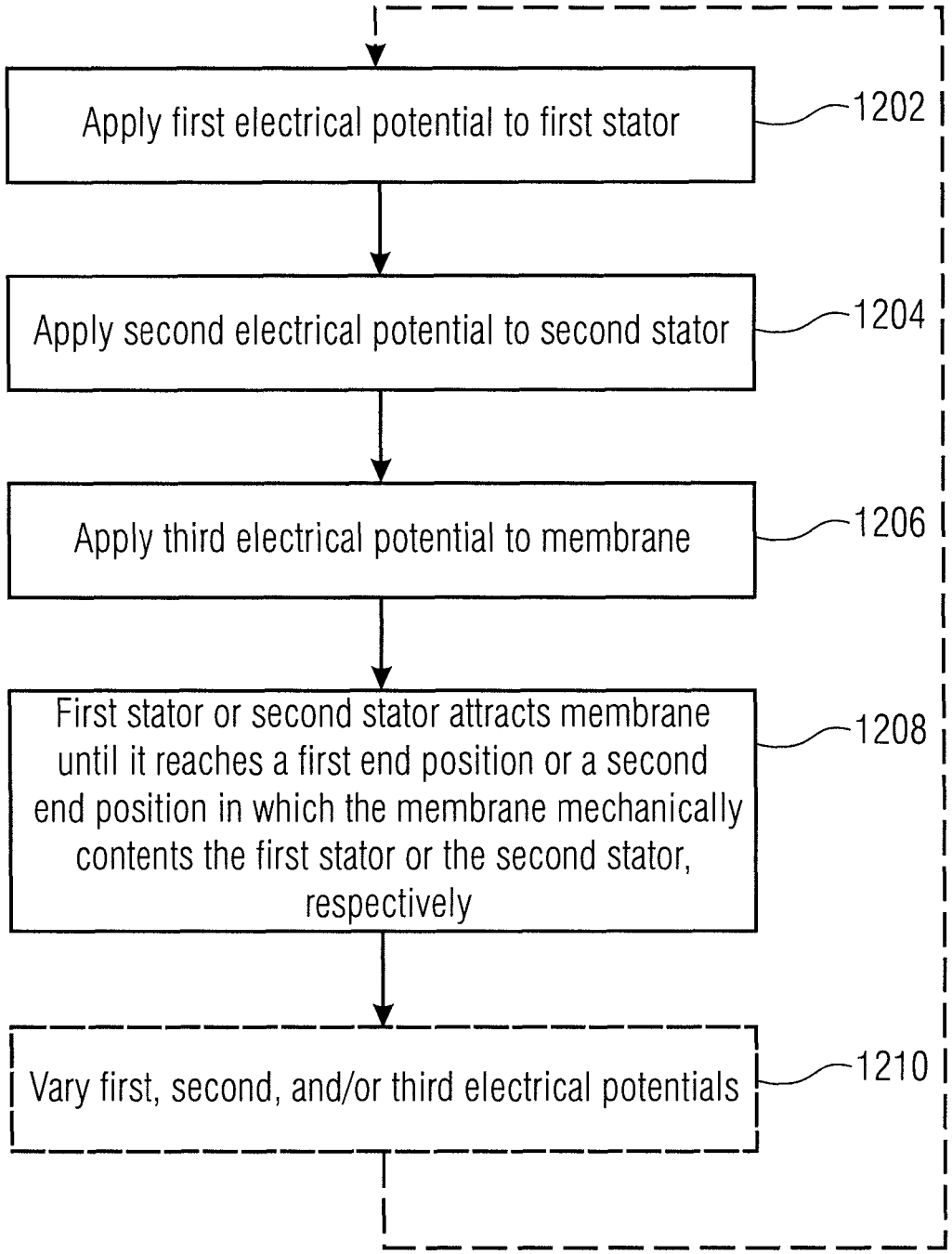
FIG. 12 is a schematic flow diagram of a method for operating a digital loudspeaker.

FIG. 12 shows a schematic flowchart of a method for operating a digital loudspeaker according to the teachings disclosed herein. At 1202 a first electrical potential is applied to the first stator 12. At 1204, a second electrical potential is applied to the second stator 16. At 1206, a third electrical potential is applied to the membrane 14. The actions 1202, 1204, and 1206 may be performed in any other order and are typically formed concurrently so that different electrical potentials are applied to the stators 12, 16, and the membrane 14 at a specific time instant.

At 1208, the different electrical potentials cause the first stator 12, or the second stator 16 to attract the membrane 14 until the membrane 14 reaches a first end position or a second end position, respectively. In the first position, the membrane 14 mechanically contacts the first stator 12. In the second end position, the membrane 14 mechanically contacts the second stator 16.

Typically, at least one of the first electrical potential, the second electrical potential, and the third electrical potential is varied over time in order to cause the membrane to alternatingly assume the first end position and the second end position, as indicated in an optional block 1210. For example, an oscillator may be connected to at least one of the first stator 12, the second stator 16, and the membrane 14. Another option would be to connect, for example, the first stator to a pair of switches which, in turn, are connected to different electrical potentials. The pair of switches may be alternatingly operated so that the first stator 12 is alternatingly connected to one of the different electrical potentials. Of course, a similar structure may be used to apply alternatingly varying electrical potentials to the second stator 16 or the membrane 14. An exemplary implementation of a driving circuit for driving at least one of the first stator, the second stator, and the membrane may comprise an H-bridge.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

What is claimed is:

1. A digital loudspeaker comprising:

a substrate;

a first stator fixed with respect to the substrate;

a second stator fixed with respect to the substrate and spaced at a distance from the first stator; and a membrane between the first stator and the second stator and displaceable between a first position in which the membrane mechanically contacts the first stator and a second position in which the membrane mechanically contacts the second stator, wherein the first stator and the second stator are arranged to electrostatically move the membrane between a rest position spaced apart from the first position and the second position and the first position and the second position, and wherein at least one of the first stator and the second stator comprises at least one elevation protruding from a surface thereof facing the membrane, wherein the membrane mechanically contacts the first stator and the second stator substantially at the elevation, or wherein the membrane comprises at least one elevation protruding from a membrane surface in a direction of at least one of the first stator and the second stator.

2. The digital loudspeaker according to claim 1, wherein the first stator and the second stator extend substantially parallel to a main surface of the substrate.

3. The digital loudspeaker according to claim 1, wherein the first stator is spaced from the membrane by a first gap width at the rest position and the second stator is spaced from the membrane by a second gap width at the rest position, wherein the first gap width is substantially the same as the second gap width.

4. The digital loudspeaker according to claim 1, further comprising a support structure that connects the substrate to the second stator.

5. The digital loudspeaker according to claim 1, wherein the mechanical contact between the membrane and the first stator while in the first position or the membrane and the second stator while in the second position occurs within a circumscribing area that is between 30% and 90% of a total area of the membrane, the circumscribing area comprising a contact spot or contact spots between the membrane and the first stator or the second stator.

6. The digital loudspeaker according to claim 1, wherein the first stator comprises a main layer of a stator material and a tension stress layer.

7. The digital loudspeaker according to claim 6, wherein the stator material comprises polysilicon and the tension stress layer comprises silicon nitride.

8. The digital loudspeaker according to claim 1, wherein at least one of the first stator, the second stator and the membrane comprises doped semiconductor material.

9. The digital loudspeaker according to claim 1, wherein at least one of the first stator, the second stator, and/or the membrane comprises an opening for connecting a first volume at a first main surface with a second volume at a second main surface of the first stator, the second stator, or the membrane, respectively.

10. The digital loudspeaker according to claim 1, wherein the substrate comprises a cavity adjacent to the first stator.

11. The digital loudspeaker according to claim 1, wherein the first stator, the membrane, and the second stator are arranged within a stack over a main surface of the substrate.

12. The digital loudspeaker according to claim 1, wherein the membrane comprises a corrugation for facilitating a deflection of the membrane to the first position and the second position.

13. The digital loudspeaker according claim 1, further comprising an electrical potential provisioning structure adapted to provide a first electrical potential to the first stator, a second electrical potential to the second stator, and a third electrical potential to the membrane, the electrical potentials being at least temporarily different one from the other.

14. The digital loudspeaker according to claim 1, wherein the at least one of the first and the second stator comprises the at least one elevation protruding from the surface facing the membrane and wherein the membrane comprises the at least one elevation protruding from the surface in the direction to the other stator.

15. The digital loudspeaker according to claim 14, wherein the second stator comprises the at least one elevation protruding from the surface facing the membrane and wherein the membrane comprises the at least one elevation protruding from the surface in the direction to the first stator.

16. A digital loudspeaker arrangement comprising:

an array of digital loudspeakers; and a substrate that is common for the array of digital loudspeakers;

wherein each digital loudspeaker comprises:

a first stator fixed with respect to the substrate;

a second stator fixed with respect to the substrate and spaced at a distance from the first stator; and a membrane between the first stator and the second stator and displaceable between a first position in which the membrane mechanically contacts the first stator and a second position in which the membrane mechanically contacts the second stator, wherein the first stator and the second stator are arranged to electrostatically move the membrane from a rest position spaced apart from the first position and the second position to the first position and the second position, respectively, and wherein at least one of the first stator and the second stator comprises at least one elevation protruding from a surface thereof facing the membrane, wherein the membrane mechanically contacts the first stator and the second stator substantially at the elevation, or wherein the membrane comprises at least one elevation protruding from a membrane surface in a direction of at least one of the first stator and the second stator.

17. A digital loudspeaker comprising:

a membrane having a first main surface and being arranged in a sound transducing region;

a first stator having a second main surface in parallel to the first main surface of the membrane on a side of a first free volume opposite the first main surface; and a second stator having a third main surface in parallel to the first main surface of the membrane on a side of a second free volume adjacent to the first main surface, wherein the membrane has a rest position spaced apart from the first stator and the second stator, and wherein the first stator and the second stator are adapted to electrostatically attract the membrane towards the first stator or the second stator until the membrane mechanically contacts the first stator or the second stator, respectively, and wherein at least one of the first stator and the second stator comprises at least one elevation protruding from a surface thereof facing the membrane, wherein the membrane mechanically contacts the first stator and the second stator substantially at the elevation, or wherein the membrane comprises at least one elevation protruding from a membrane surface in a direction of at least one of the first stator and the second stator.

* * * * *